US009502014B1

(12) United States Patent
Fujiwara et al.

(10) Patent No.: US 9,502,014 B1
(45) Date of Patent: Nov. 22, 2016

(54) ACTUATOR CONTROL IN AUTOMATIC PERFORMANCE OF MUSICAL INSTRUMENT

(71) Applicant: YAMAHA CORPORATION, Hamamatsu-shi, Shizuoka-Ken (JP)

(72) Inventors: Yuji Fujiwara, Hamamatsu (JP); Yasuhiko Oba, Hamamatsu (JP); Yoshiya Matsuo, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/156,613

(22) Filed: May 17, 2016

(30) Foreign Application Priority Data

May 20, 2015 (JP) ..... 2015-103123

(51) Int. Cl.
*G10F 1/02* (2006.01)
*G10F 5/02* (2006.01)

(52) U.S. Cl.
CPC .. *G10F 1/02* (2013.01); *G10F 5/02* (2013.01)

(58) Field of Classification Search
CPC ..... G10F 1/02
See application file for complete search history.

(56) References Cited

U.S. PATENT DOCUMENTS 7,235,727 B2 * 6/2007 Fujiwara ..... G10F 1/02 84/19
7,238,873 B2 * 7/2007 Fujiwara ..... G10F 1/02 84/13
7,332,670 B2 * 2/2008 Fujiwara ..... G10F 1/02 84/719
7,405,350 B2 * 7/2008 Sasaki ..... G10G 3/04 84/13
7,420,116 B2 * 9/2008 Fujiwara ..... G10F 1/02 84/601
7,528,309 B2 * 5/2009 Fujiwara ..... G10F 1/02 84/13
7,754,957 B2 * 7/2010 Ohta ..... G10F 1/02 84/615
2005/0211048 A1 * 9/2005 Fujiwara ..... G10G 3/04 84/13
2005/0211079 A1 * 9/2005 Sasaki ..... G10G 3/04 84/723
2006/0016325 A1 1/2006 Fujiwara et al.
2006/0225563 A1 * 10/2006 Ohba ..... G10F 1/02 84/744

FOREIGN PATENT DOCUMENTS

JP 4222210 B2 2/2009

* cited by examiner

*Primary Examiner* — Robert W Horn
(74) *Attorney, Agent, or Firm* — Rossi, Kimms & McDowell LLP

(57) ABSTRACT

An actuator includes a movable member that, when moving, abuts against a key (performance operator) to move the key. A first sensor detects motion of the key. A second sensor detects motion of the movable member. A processor determines, based on outputs of the sensors, whether or not the key and the movable member are currently in a mutually separated state. When the key and the movable member are in the mutually separated state, the processor controls the actuator in such a manner that the key and the movable member are in contact with each other. When the key and the movable member are not in the mutually separated state, the processor controls the actuator by use of feedback information based on the output of the first sensor, whereas, in the mutually separated state, the actuator is controlled by feedback information based on at least the second sensor output.

13 Claims, 18 Drawing Sheets

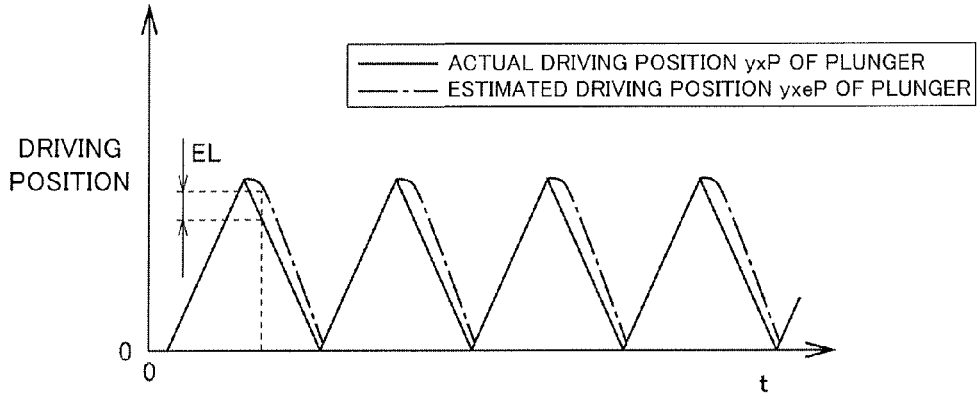
F I G. 6 A
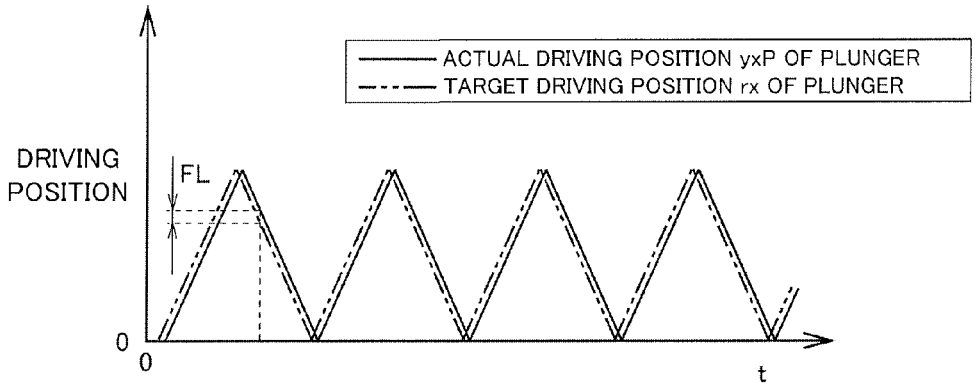
F I G. 6 B
DT
| ch | KC | kx | kv | ST | TM | DP |
|---|---|---|---|---|---|---|
| 1 | | | | | | |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |
F I G. 7

ACTUATOR CONTROL IN AUTOMATIC PERFORMANCE OF MUSICAL INSTRUMENT

BACKGROUND

The present invention relates generally to actuator control in an automatic performance of a musical instrument. More particularly, the present invention relates to a keyboard musical instrument which includes actuators for operating performance operators and executes an automatic performance by controlling the actuators in accordance with performance instructions, as well as an automatic performance programs.

There have heretofore been known auto player pianos (auto playing pianos or automatic performance pianos) provided with solenoids that are actuators (drive device) for driving keys that are performance operators. The auto player pianos are constructed to execute an automatic performance by driving the solenoids on the basis of performance information to thereby move or operate the keys with plungers (movable members) of the solenoids, as disclosed for example in Japanese Patent No. 4222210 (hereinafter referred to as "Patent Literature 1").

The auto player piano disclosed in Patent Literature 1 includes key sensors each for detecting a stroke position or velocity of a corresponding one of the keys, and plunger sensors each for detecting a plunger position or plunger velocity of a corresponding one of the solenoids. The auto player piano feeds, back to servo control performed on the basis of the performance information, a signal based on a stroke position or velocity of a key detected by each of the key sensors and a plunger position or plunger velocity detected by each of the plunger sensors. In this way, the auto player piano can enhance an accuracy of driving, by each of the solenoids, of the corresponding key. However, the technique disclosed in Patent Literature 1 does not take into consideration accurate correlative relationship between action of the key and action of the solenoid. Thus, in a quick performance style where the key cannot appropriately follow motion of the solenoid (e.g., in a performance style where one key is hit successively at quick speed), the action of the key and the action of the solenoid cannot be appropriately harmonized with each other, which would cause unwanted operational disharmony or discrepancy between the action of the key and the action of the solenoid. Thus, the key and the plunger (movable member) of the solenoid may sometimes anomalistically move out of contact with, i.e. separate or move away from, each other and hit each other to generate driving noise (sound). In addition, the motion of the keys would become unstable so that an accurate automatic performance sometimes cannot be executed.

SUMMARY OF THE INVENTION

In view of the foregoing prior art problems, it is an object of the present invention to provide a technique for appropriately controlling an actuator in an automatic performance of a musical instrument in such a manner as to prevent operational disharmony or discrepancy between action of a performance operator (key) and action of the actuator and thereby suppress generation of driving noise and permit execution of a stable and accurate automatic performance of the musical instrument.

In order to accomplish the abovementioned object, the present invention provides an improved musical instrument, which comprises: a performance operator; an actuator configured to actuate the performance operator, the actuator including a movable member that, when moving, abuts against the performance operator to move the performance operator; a first sensor configured to detect motion of the performance operator; a second sensor configured to detect motion of the movable member of the actuator; and a processor that determines, based on outputs of the first and second sensors, whether or not the performance operator and the movable member of the actuator are currently in a mutually separated state, and that, upon determination that the performance operator and the movable member are currently in the mutually separated state, controls the actuator in such a manner that the performance operator and the movable member are in contact with each other.

The present invention is constructed with relative positional relationship between the performance operator and the movable member into consideration. Namely, according to the present invention, when it has been determined that the performance operator and the movable member are currently in the mutually separated state (in other words, when the performance operator and the movable member are not currently maintained in contact with each other), the actuator is controlled in such a manner that the performance operator and the movable member are in contact with each other. In this manner, the present invention can prevent operational disharmony or discrepancy in action between the performance operator (key) and the actuator to thereby suppress generation of driving noise (sound), so that it can execute a stable and accurate automatic performance.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIG. 6A is a diagram showing a manner in which a single key and a movable member of an actuator operate during consecutive hitting of the single key in the first embodiment of the keyboard musical instrument of the present invention, and FIG. 6B is a diagram showing a manner of operation relative to a target driving position of the actuator during the consecutive hitting of the single key in the first embodiment of the keyboard musical instrument of the present invention;

FIG. 7 is a diagram showing a key operating table in driving information of the keyboard musical instrument of the present invention;

DETAILED DESCRIPTION

First Embodiment

Figure 1:
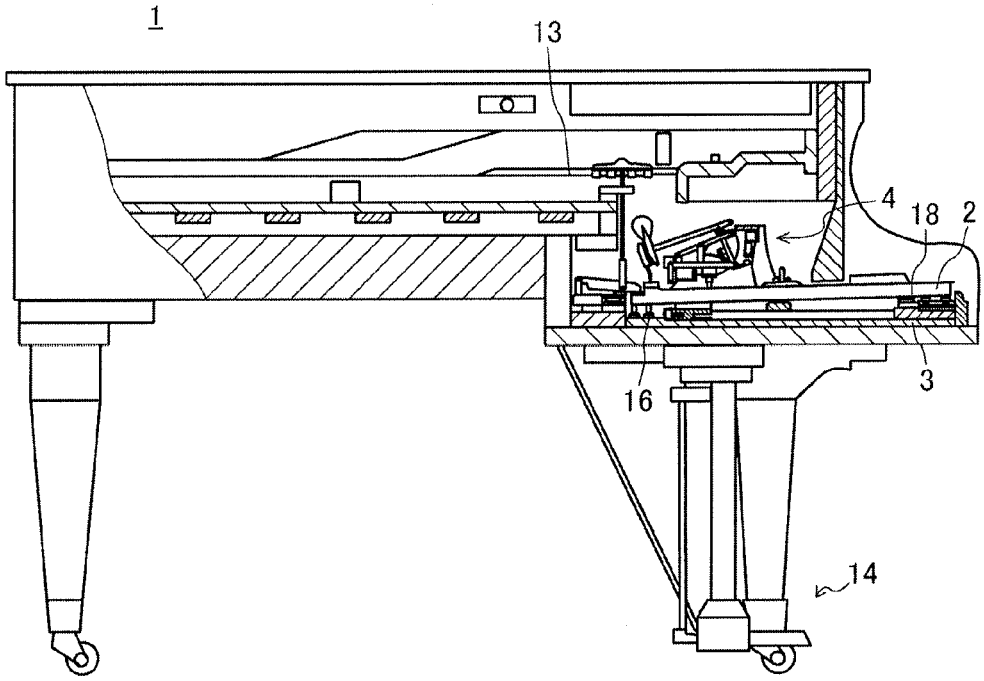
FIG. 1 is a partially-sectional side view showing a general setup of a keyboard musical instrument of the present invention.

Now, with reference to FIGS. 1 to 3, a description will be given about an auto player piano (auto playing piano) 1 that is a keyboard musical instrument according to a first embodiment of the present invention. As seen in FIG. 1, the auto player piano 1 according to the embodiment is a grand piano. The auto player piano 1 can execute an automatic performance by operating keys (black and white keys) 2, which are performance operators, and a pedal 4 in accordance with driving information generated from performance information. One side of the auto player piano 1 where a human player operates the keys 2 will be referred to as "operation side", while the other side where strings are stretched taut will be referred to as "string side".

Figure 2:
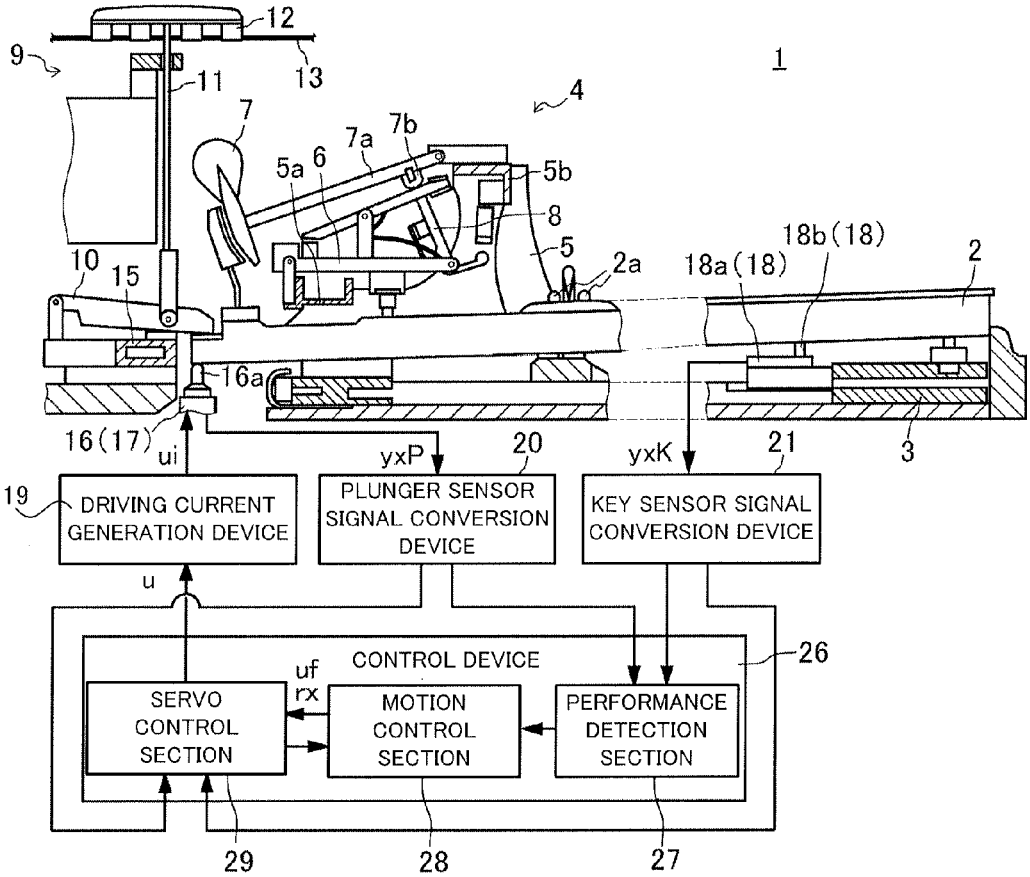
FIG. 2 is a schematic view showing constructions of a drive mechanism and a control device for automatic performance execution in a first embodiment of the keyboard musical instrument of the present invention.
Figure 3:
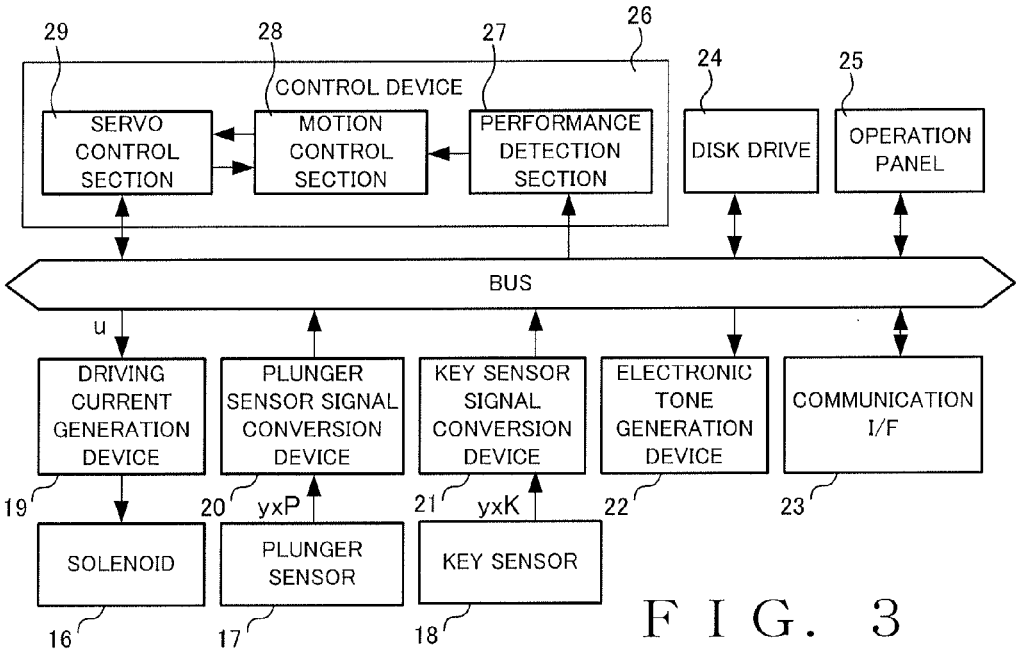
FIG. 3 is a block diagram showing controlling arrangements in the first embodiment of the keyboard musical instrument of the present invention.

The auto player piano 1 in the form of a grand piano includes: solenoids 16 that are actuators provided in corresponding relation to the keys (performance operators) 2; plunger sensors 17 for detecting driving states of the corresponding actuators; key sensors 18 provided in corresponding relation to the keys 2 for detecting operating states of corresponding performance operators; driving current generation devices 19 (see FIGS. 2 and 3); plunger sensor signal conversion devices 20 (see FIGS. 2 and 3); key sensor signal conversion devices 21 (see FIGS. 2 and 3); and a control device 26 (see FIGS. 2 and 3). The auto player piano 1 is constructed to not only permit operations, by the human player, of the keys 2 and the pedal 14 but also permit operations of the individual keys 2 through independent driving by the corresponding solenoids 16. Thus, the auto player piano 1 allows the human player to perform a music piece by operating the keys 2 and the pedal 14 but also can automatically perform a music piece by driving a plurality of the solenoids 16 independently of one another in accordance with driving information to thereby operate the keys 2.

In the auto player piano 1, as shown in FIGS. 1 and 2, the solenoids 16, the plunger sensors 17 and the key sensors 18 are provided on a key frame 3 that supports the keys 2 and action mechanisms (string striking mechanisms) 4 provided for the individual keys 2. Each of the keys 2 is supported at its substantially middle portion via a balance key pin 2*a* in such a manner that it is pivotable in a vertical or up-down direction. Each of the action mechanisms 4 is supported by the key frame 3 via an action bracket 5 on the string side of the key 2. Further, a damper mechanism 9 is disposed on a string-side end portion of each of the keys 2.

Further, as shown in FIG. 2, each of the action mechanisms 4 is constructed to strike the corresponding key 2 and mainly includes a support 6, a hammer 7, a jack 8, etc. The support 6 is a rod-shaped member disposed to extend from the string side to the operation side. The support 6 has a string-side end portion supported on a support rail 5*a* and is constructed to be pivotable in the up-down direction. The hammer 7 is supported on a shank rail 5*b* via a rod-shaped hammer shank 7*a* disposed to extend from the operation side to the string side. The hammer shank 7*a* is pivotable in the up-down direction about its operation-side end portion. Namely, the hammer 7 is movable in the up-down direction via the hammer shank 7*a*. During rest, the jack 8 is kept in contact with a hammer roller 7*b* fixed to the hammer shank 7*a*. The jack 8 is supported at its one end by an operation-side end portion of the support 6, and the other end of the jack 8 supports an operation-side end portion (pivot point side) of the hammer shank 7*a*. In the action mechanism 4 constructed in this manner, the support 6 is pivoted upward as the string side of the key 2 pivotally moves upward in response to a depressing operation or the like of the key 2. The hammer shank 7*a* supported on the support 6 via the jack 8 is pivoted upward in response to the upward pivoting movement of the support 6. The hammer 7 supported by the hammer shank 7*a* is pivoted upward in response to the upward pivoting movement of the hammer shank 7*a*. Thus, in the action mechanism 4, the jack 8 moves out of contact with, i.e. separates from, the hammer roller 7*b*, so that a string (more specifically string set) 13 is struck by the hammer 7. After striking the string 13, the hammer 7 moves away from the string 13.

The damper mechanism 9 is constructed to move a damper 12 into and out of contact with the string 13. The damper mechanism 9 includes a damper lever 10, a damper wire 11, the damper 12, etc. The damper lever 10 is in the form of a rod extending from the string side to the operation side and has an operation-side end portion supported on a string-side end portion of the key 2. Further, the damper wire 11 is connected to an intermediate portion of the damper lever 10. Further, the damper 12 is not only disposed to contact the string 13 from above the string 13 but also connected to the damper lever 10 via the damper wire 11. Further, the damper lever 10 is constructed to be pivotable upward via a lifting rail 15 interlockingly connected to the pedal 14. In the damper mechanism 9 constructed in the aforementioned manner, the damper lever 10 supported on the key 2 is pivoted upward in response to upward pivotal movement of a string-side portion of the key 2. The damper 12 is moved upward by the damper wire 11 in response to the upward pivoting movement of the damper lever 10. In this manner, the damper mechanism 9 moves or separates the damper 12 away from the string 13. Further, in the damper mechanism 9, the damper 12 is brought into contact with the string 13 in response to the string-side portion of the key 2 pivotally moving downward.

The solenoid 16 is an actuator for driving the key 2. The solenoid 16 is constructed in such a manner that a plunger 16*a*, i.e. a movable member, moves out and into the body of the solenoid 16 by the action of a solenoid coil energized by a driving current. The solenoid 16 is disposed under the string-side end portion of the key 2 in such a manner that the plunger 16*a* contacts the lower surface of the key 2 in opposed relation to the latter. Namely, in the solenoid 16, the plunger 16*a* projects (moves upward) from the body of the solenoid to thereby lift the string-side end portion of the key 2 while contacting the lower surface of the key 2.

Further, as shown in FIGS. 2 and 3, the plunger sensor 17 for detecting motion of the actuator solenoid 16 is constructed to continuously detect an actual driving position yxP that is a distance of the ascending or descending plunger 16*a* (see FIG. 2) from a reference position of the plunger 16*a*. More specifically, the plunger sensors 17 are incorporated in individual cones of the solenoids 16, each of which detects an actual driving position yxP of the plunger 16*a* on the basis of an induced electromotive force of a not-shown solenoid coil or the like. The plunger sensor 17 outputs the detected actual driving position yxP as an analog signal. Note that such a plunger sensor 17 may be constructed in any other desired manner than the aforementioned as along as it can appropriately detect an actual driving position yxP of the plunger 16*a*.

Each of the key sensors 18 which detects motion of the key 2 functioning as a performance operator is constructed to continuously detect an actual operating position yxK that is a distance of the key 2 from a reference position of the key 2. The key sensor 18 is, for example, in the form of an optical position sensor that outputs a detection signal corresponding to an amount of received light from a light emitting diode. As shown in FIG. 2, the key sensor 18 comprises a sensor body 18*a* and a dog (light blocking plate) 18*b* for changing the amount of received light in accordance with a position thereof. The key sensor 18 is disposed at a position of the key frame 3 that is opposed to the lower surface of the corresponding key 2. The dog (light blocking plate) 18*b* of the key sensor 18 is disposed on the lower surface of the key sensor 18 in such a manner as to block the light emitted from the light emitting diode in accordance with the actual operating position yxK of the key 2. The key sensor 18 outputs the detected actual operating position yxK as an analog signal. Note that such a key sensor 18 may be constructed in any other desired manner than the aforementioned as along as it can appropriately detect the actual operating position yxK of the key 2.

Further, as shown in FIGS. 2 and 3, the driving current generation devices 19 are provided in corresponding relation to the solenoids 16 and connected to the corresponding solenoids 16 to supply electric currents to the corresponding solenoids 16. More specifically, each of the driving current generation devices 19 supplies the corresponding solenoid 16 with a plunger driving current ui of the PWM (Pulse Width Modulation) form. The driving current generation devices 19 are constructed to be capable of supplying such plunger driving current ui to the solenoids 16 independently of one another.

Further, the plunger sensor signal conversion devices 20 are provided in corresponding relation to the plunger sensors 17 and connected to the plunger sensors 17, so as to convert into digital signals analog signals output from the corresponding plunger sensors 17 and indicative of actual driving positions yxP of the corresponding plungers 16*a*. The plunger sensor signal conversion devices 20 are constructed to be capable of converting analog signals, output from the corresponding plunger sensors 17 and indicative of actual driving positions yxP of the corresponding plungers 16*a*, into digital signals indicative of the actual driving positions yxP independently of one another.

Further, the key sensor signal conversion devices 21 are provided in corresponding relation to the key sensors 18 and connected to the key sensors 18, so as to convert into digital signals analog signals output from the corresponding key sensors 18 and indicative of actual operating positions yxK of the corresponding keys 2. The key sensor signal conversion devices 21 are constructed to be capable of converting analog signals, output from the corresponding key sensors 18 and indicative of actual operating positions yxK of the corresponding keys 2, into digital signals indicative of the actual operating positions yxK independently of one another.

Further, as shown in FIG. 3, the auto player piano (auto playing piano or automatic performance piano) 1 includes an electronic tone generation device 22, a communication interface 23, a disk drive 24, an operation panel 25 and a control device 26. The electronic tone generation device 22, which generates an electronic tone, includes a tone generator for generating an electronic tone signal, a speaker, etc. The electronic tone generation device 22 is used to generate accompaniment tones in an automatic performance, generate tones in a silent mode (i.e., performance state with no string striking involved), etc.

The communication interface (I/F) 23 is provided for communicating with other equipment. More specifically, the communication interface 23 communicates (receives and transmits) control signals, music piece data, various other data, control programs, etc. through wired and wireless communication, etc.

The disk drive 24 is provided for acquiring information recorded on storage media, such as a DVD. More specifically, the disk drive 24 reads out music piece data, various other data, control programs, etc. stored on storage media, such as a DVD.

The operation panel 25 is provided for allowing a human operator or user to operate the auto player piano 1 and make various settings for the auto player piano 1. The operation panel 25 includes, among other things, a display screen, such as a liquid crystal display, and manual operators, or touch panel. More specifically, the operation panel 25 allows the user to, for example, select a music piece, start and stop an automatic performance, record a performance, set various operation modes, and display various information, such as a musical score.

Further, as shown in FIGS. 2 and 3, the control device 26 controls the auto player piano 1. As an example, the control device 26 comprises a general-purpose hardware setup including a CPU (Central Processing Unit), a ROM (Read-Only Memory), a RAM (Random Access Memory). an HDD (Hard Disk Drive), etc., and the control device 26 is constructed to perform various control and processing in accordance with necessary computer programs. However, the control device 26 is not so limited and may comprise dedicated hardware, such as a one-chip LSI (Large Scale Integrated Circuit), that is constructed to perform necessary control and processing functions. The control device 26 controls various components or sections of the auto player piano 1 on the basis of control programs and control data stored in a storage device, such as an HDD. The control device 26 includes a performance detection section 27, a motion control section 28 and servo control sections 29. In the control device 26, various information is transmitted from the performance detection section 27 to the motion control section 28, and various information is transmitted between the motion control section 28 and the servo control sections 29.

The performance detection section 27 generates information about motion of the keys 2 and the corresponding solenoids 16. On the basis of actual driving positions yxP of the plungers 16*a* converted into digital signals in the plunger sensor signal conversion devices 20, the performance detection section 27 time-serially generates information, such as event timing of the individual keys 2 and actual driving positions yxP of the individual plungers 16*a*. The performance detection section 27 transmits the thus-generated motion information of the solenoids 16 to the motion control section 28. Similarly, the performance detection section 27 time-serially generates information, such as event timing of the individual keys 2 and actual operating positions yxK of the individual keys 2. The performance detection section 27 transmits the thus-generated motion information of the keys 16 to the motion control section 28.

The motion control section 28 generates time-serial data of target driving positions rx, which is driving information of the plunger 16*a* of the solenoid 16, on the basis of performance information as a driving information generation step; such data of target driving positions rx will hereinafter be referred to simply as "target driving position rx". The motion control section 28 acquires time-serial data of target operating positions (key driving data as show in FIG. 7) from a storage device, such as a RAM, constituting the control device 26. Further, the motion control section 28 acquires motion information of the solenoid 16 and motion information of the key 2 generated by the performance detection section 27. The motion control section 28 generates the target driving position rx on the basis of the acquired key driving data and motion information of the solenoid 16 and the key 2. Then, the motion control section 28 transmits to the servo control section 29 (see FIG. 5) the generated target driving position rx and a fixed driving amount of corresponding to a minimum necessary thrust force for driving the solenoid 16.

The servo control section 29 performs a function as a fundamental servo controller constructed to servo-control the operation of the actuator (solenoid 16) for driving the performance operator (key 2) in accordance with the target driving position rx and necessary feedback information, and a function as a processor that determines whether or not the performance operator (key 2) and the movable member (plunger 16*a*) of the actuator (solenoid 16) are currently in the mutually separated state, and that, upon determination that the performance operator and the movable member are currently in the mutually separated state, controls the actuator in such a manner that the movable member approaches the performance operator. As a separation determination step, the servo control section 29 determines whether or not the key 2 and the plunger 16*a* of the solenoid 16 are currently out of contact with each other, i.e. currently in a mutually separated state, and then, as a compensation step, the servo control section 29 generates a plunger driving amount u of the solenoid 16 based on a result of the separation determination step. The servo control section 29 is constructed to perform servo control individually on each of the keys 2. The servo control section 29 acquires the target driving positions rx and fixed driving amount uf generated by the motion control section 28. Further, the servo control section 29 acquires the digital signal indicative of the actual driving position yxP of the plunger 16*a* from the plunger sensor signal conversion device 20 and acquires the digital signal indicative of the actual operating position yxK of the key 2 from the key sensor signal conversion device 21. Then, the servo control section 29 determines, on the basis of the acquired actual driving position yxP of the plunger 16*a* and actual operating position yxK of the key 2, whether or not the key 2 and the plunger 16*a* of the solenoid 16 are currently spaced from each other, i.e. in the mutually separated state, and the servo control section 29 generates a plunger driving amount u on the basis of the target driving position rx and fixed driving amount uf of the plunger 16*a*.

Further, as shown in FIG. 3, the control device 26 is connected via a bus to the plurality of driving current generation devices 19 corresponding to the individual solenoids 16, and the servo control section 29 of the control device 26 can transmit plunger driving amounts u corresponding to the driving current generation devices 19.

Further, the control device 26 is connected via the bus to the plurality of plunger sensor signal conversion devices 20 corresponding to the individual plunger sensors 17, and the performance detection section 27 and the servo control section 29 of the control device 26 can acquire, from the individual plunger sensor signal conversion devices 20, digital signals indicative of actual driving positions yxP of the plungers 16*a*. Similarly, the control device 26 is connected via the bus to the plurality of key sensor signal conversion devices 21 corresponding to the individual key sensors 18, and the performance detection section 27 and the servo control section 29 of the control device 26 can acquire, from the individual key sensor signal conversion devices 21, digital signals indicative of actual operating positions yxK of the keys 2.

Further, the control device 26 is connected via the bus to the electronic tone generation device 22, so that it can control the electronic tone generation device 22. Furthermore, the control device 26 is connected via the bus to the communication interface 23 so that it can communicate with external equipment via the communication interface 23. Furthermore, the control device 26 is connected via the bus to the disk drive 24 so that it can acquire, via the disk drive 24, information stored in a storage medium, such as a DVD. Moreover, the control device 26 is connected via the bus to the operation panel 25 so that it can acquire various operating and setting-related signals of the auto player piano 1 via the operation panel 25 and display various information, such as a musical score, on the display screen.

Figure 4:
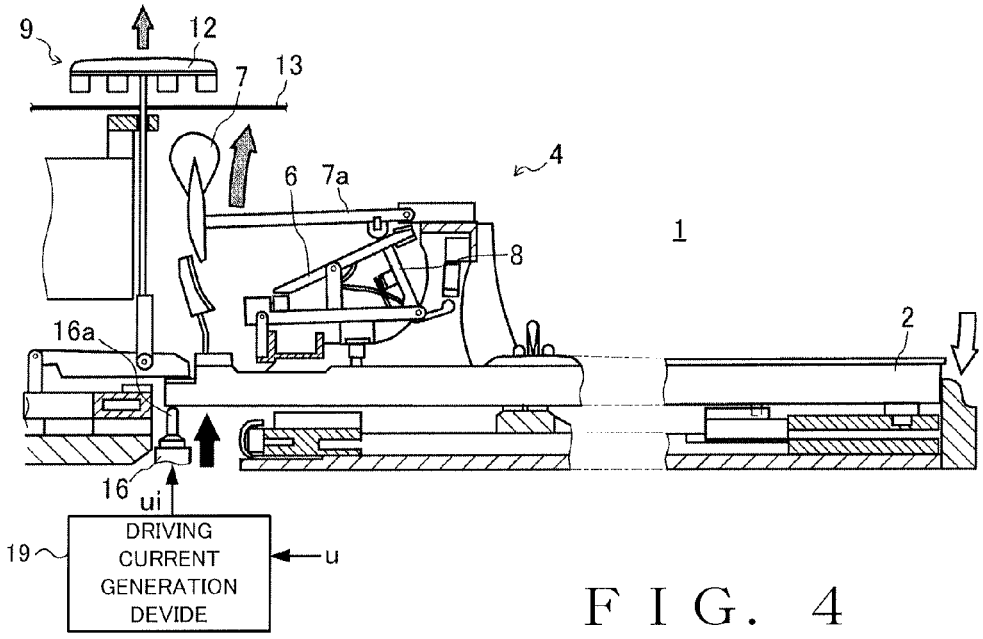
FIG. 4 is a schematic diagram showing a manner in which a string is struck by an actuator in the first embodiment of the keyboard musical instrument of the present invention.

Further, as shown in FIG. 4, the auto player piano 1 transmits, to the driving current generation device 19, a plunger driving amount u that is driving information (i.e., compensated driving information) generated by the control device 26 (see FIGS. 2 and 3) on the basis of performance information. The driving current generation device 19 supplies the solenoid 16 with a plunger driving current ui corresponding to the plunger driving amount u. The solenoid 16 moves upward the plunger 16*a* to a position corresponding to the plunger driving current ui (see a black upward arrow in FIG. 4) to thereby pivotally move upward the string-side end portion of the corresponding key 2. Thus, the key 2 not only causes the hammer 7 to strike the string 13 via the support 6, jack 8 and hammer shank 7*a* of the action mechanism 4 but also causes the damper 12 of the damper mechanism 9 to move away from the string 13 (see a shaded upward arrow in FIG. 4).

Figure 5:
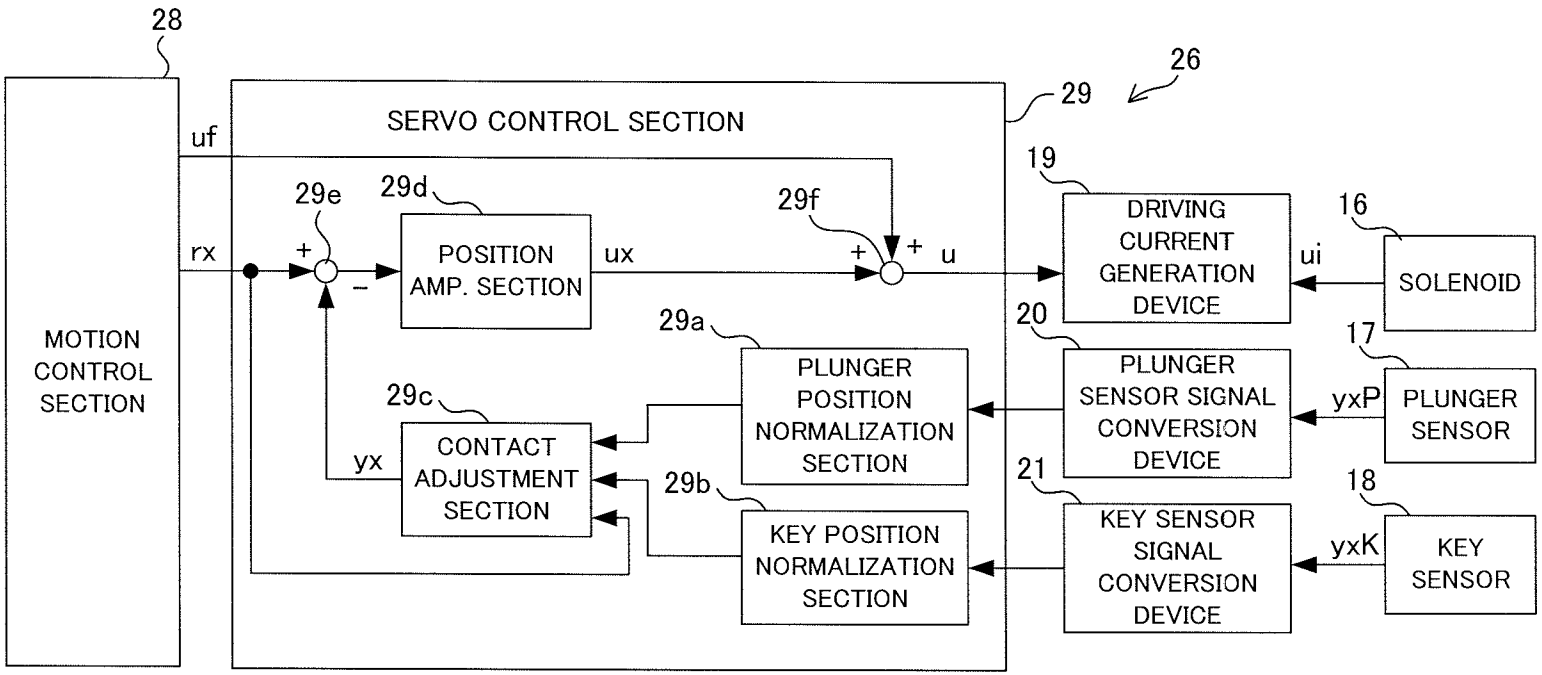
FIG. 5 is a schematic diagram showing a manner in which signals are transmitted from the control device in the first embodiment of the keyboard musical instrument of the present invention.

The following describe, with reference to FIGS. 5, 6A and 6B, control performed by the servo control section 29 of the control device 26 at the separation determination step and at the compensation step.

As shown in FIG. 5, the servo control section 29 includes a plunger position normalization section 29*a*, a key position normalization section 29*b*, a contact adjustment section 29*c* that is a determination means, and a position amplification section 29*d*. The plunger position normalization section 29*a* acquires, from the plunger sensor signal conversion device 20, a digital signal indicative of an actual driving position yxP of the plunger 16*a* and performs normalization processing on the thus-acquired digital signal. Similarly, the key position normalization section 29*b* acquires, from the key sensor signal conversion device 21, a digital signal indicative of an actual operating position yxK of the key2 and performs normalization processing on the thus-acquired digital signal. Note that the "normalization processing" is for matching scales of the digital signals indicative of the actual driving position yxP of the plunger 16*a* and the actual operating position yxK of the key2 so that the two digital signals can be set at mutually comparable values.

The contact adjustment section 29*c*, which is a determination means, not only determines whether or not the key 2 and the plunger 16*a* of the solenoid 16 are currently in the mutually separated state but also generates a feedback position yx (feedback information). Namely, the contact adjustment section 29*c* performs the separation determination step B to determine whether or not the key 2 and the plunger 16*a* of the solenoid 16 are currently in the mutually separated state (see FIG. 9), and the compensation step C to generate a feedback position yx for compensating a target driving position rx and feeding the generated position compensation amount yx back to the target driving position rx (see FIG. 9). The contact adjustment section 29*c* acquires the actual driving position yxP of the plunger 16*a* normalized by the plunger position normalization section 29*a* and the actual operating position yxK of the key 2 normalized by the key position normalization section 29*b*. Further, the contact adjustment section 29*c* acquires the target driving position rx of the plunger 16*a* generated by the motion control section 28.

Further, FIG. 6A shows an example of relationship between the actual driving position yxP of the plunger 16*a* and an estimated driving position yxeP of the plunger 16*a* determined from the actual operating position yxK of the key 2 when the single key 2 is hit consecutively, and FIG. 6B shows an example of relationship between the target driving position rx of the plunger 16*a* and the actual driving position yxP of the plunger 16*a* when the single key 2 is hit consecutively. At the separation determination step, the contact adjustment section 29*c* determines that the key 2 and the plunger 16*a* are currently maintained in contact with each other (in a mutually contacting state) if a separated position deviation EL (FIG. 6A) that is a deviation between the actual driving position yxP of the plunger 16*a* and the estimated driving position yxeP of the plunger 16*a* determined from the actual operating position yxK of the key 2 is less than a position deviation reference value (threshold value) Ls that is a value for determining whether or not the key 2 and the plunger 16*a* are currently in the mutually separated state. In this case, the contact adjustment section 29*c* outputs the estimated driving position yxeP of the plunger 16*a* as a feedback position yx to be fed back to the target driving position rx, at the compensation step C. Namely, when the key 2 and the plunger 6*a* are in contact with each other, control is performed based on the actual operating position yxk of the key 2, so that a stable and accurate automatic performance can be executed. Further, at the separation determination step, when the separated position deviation EL is equal to or more than the position deviation reference value (threshold value) Ls, the contact adjustment section 29*c* determines that the key 2 and the plunger 6*a* are currently in the mutually separated state. Namely, at the compensation step C, when a tracking position deviation FL (FIG. 6B) that is a deviation between the target driving position rx of the plunger 16*a* and the actual driving position yxP of the plunger 16*a* is equal to or less than an allowable tracking value Ft, the contact adjustment section 29*c* outputs the actual driving position yxP of the plunger 16*a* as the feedback position yx to be fed back to the target driving position rx. Namely, when the actual driving position yxP of the plunger 16*a* is tracking the target driving position rx, a stable automatic performance is executed through control based on the actual driving position yxP of the plunger 16*a*. When the tracking position deviation FL is more than the allowable tracking value Ft at the compensation step C, on the other hand, the contact adjustment section 29*c* calculates proportionally divided values of the actual driving position yxP and estimated driving position yxeP of the plunger 16*a* in accordance with the separated position deviation EL. At that time, the proportionally divided values are calculated in such a manner that a sum of the ratio between the two values becomes "1" (one), and the calculated proportionally divided values are mixed with each other. Namely, a value indicative of an intermediate position between the actual driving position yxP and estimated driving position yxeP of the plunger 16*a* is acquired as a mixed value of the proportionally divided values of the actual driving position yxP and estimated driving position yxeP of the plunger 16*a*. Then, the contact adjustment section 29*c* outputs the mixed value of the proportionally divided values of the actual driving position yxP and estimated driving position yxeP of the plunger 16*a* as the feedback position yx to be fed back to the target driving position rx. Namely, when the actual driving position yxP of the plunger 16*a* is not tracking the target driving position rx, the plunger 16*a* is controlled to follow the target driving position rx with the actual operating position yxk of the key 2 (i.e., the estimated driving position yxeP of the plunger 16*a*) taken into account, so that the automatic performance is corrected to be stable. Namely, when the key 2 and the plunger 16*a* are currently in the mutually separated state, while the output (yxP) of the plunger sensor 31 is at least used as the feedback amount (yx), the feedback amount (yx) based on the output (yxP) of the plunger sensor 31 is variably adjusted in accordance with a tracking state, in the servo control, of the actuator (solenoid 16).

Further, in FIG. 5, a subtractor 29*e* subtracts the feedback position yx from the target driving position rx to calculate a deviation of the feedback position relative to the target position (such a deviation will hereinafter be referred to as "target position deviation"). A position amplification section 29*d* amplifies the target position deviation, output from the subtractor 29*e*, with an amplification factor (servo loop gain) that is set as desired and outputs the thus-amplified target position deviation as a target position deviation ux. An adder 29*f* adds the above-mentioned fixed driving amount uf to the target position deviation ux output from the position amplification section 29*d* and outputs the result of the addition as a plunger driving amount u.

In the servo control section 29 constructed as above, the contact adjustment section 29*c* determines, on the basis of the actual driving position yxP of the plunger 16*a* and actual operating position yxK acquired at the out-of-contact determination or separation step, whether or not the key 2 and the plunger 16*a* are currently out of contact with each other or in the mutually separated state. Further, at the compensation step C (see FIG. 9), the contact adjustment section 29*c* generates the feedback position yx based on the separation determination step. The servo control section 29 generates a target position deviation us by subtracting the feedback position yx from the target driving position rx of the plunger 16*a*. Namely, the servo control section 29 selects information to be used as the feedback position rx such that the key 2 and the plunger 16*a* are brought into contact with each other (or such that the plunger 16*a* approaches the key 2) and evaluates a position deviation of the feedback position yx relative to the target driving position rx. Further, the servo control section 29 generates a plunger driving amount u by adding together the target position deviation ux, which is compensated driving information amplified by the position amplifier 29*d*, and the fixed driving amount uf of the plunger 16*a*.

The following describe in detail, with reference to FIGS. 7 to 11, control under which the auto player piano 1, which is the keyboard instrument of the present invention, executes an automatic performance on the basis of performance information.

Once a music piece to be automatically performed in an automatic performance mode is selected via the operation panel 25 (see FIG. 3), the auto player piano 1 reads out, or acquires via the communication interface 23, music piece data and key operating data, which are performance information of the selected music piece, stored in the disk drive 24 (FIG. 3) or in a not-shown external storage device. The music piece data and key operating data read out or acquired as above are stored into a not-shown music piece data storage region and a not-shown key operating data storage region, respectively, provided in the RAM of the storage device 26.

The music piece data for use in the instant embodiment comprise a header, a series of event data, tone generation timing data and end data. The header includes a plurality of data indicative of a music piece name, an initial tone color, tone volume, performance tempo, etc. The event data include tone generation event data, tempo event data, etc. of tones other than piano tones. The tone generation timing data includes a timing clock TCL indicative of tone generation timing, in the music piece, of each of the event data. The tempo event data includes control data for changing the tempo of the automatic performance. The end data indicates an end of the music piece data. On the other hand, the key operating data that constitute driving information for use in the instant embodiment comprise a header, a series of operation event data, operation timing data and end data. The header includes data indicative of the name of the music piece. The operation event data include key Nos. KC of keys 2 to be operated, target operating positions kx of the keys 2 to be operated, target operating velocities kv of the keys 2 to be operated, key operating states ST indicative of operating states of the keys 2 (presence/absence of consecutive hitting), operating times TM of the keys 2, and damper operations DT indicative of operating styles of the dampers 12. The operation timing data are provided in association with (adjacent to) the individual operation event data and has a tempo clock TCL indicative of operating timing, in the music piece, of each of the operation event data. The end data indicates an end of the key operating data.

Further, as shown in FIG. 7, a key operating table DT, which is indicative of operation data per timing clock TCL, has a plurality of (ten in the illustrated example) channels ch1 to ch10 to which are allocated keys to be operated during each of the operation events. Note that the number of the channels may be any other suitable number than ten. In each of the channels chi ("i" is any one of integral numbers from "1" to "10") are stored a key No. KC(i), a target operating position kx(i), a target operating velocity kv(i), a key operating state S T(i), an operating time TM(i) and a damper operation DP(i). After selection and initial setting of a music piece, the control device 26 starts repetitively executing an automatic performance program of the auto player piano 1, as shown in FIGS. 8 to 11, every predetermined short time defined by a performance tempo indicated by tempo data. Here, the "predetermined short time" is, for example, a time length that is about 1/16 or 1/32 of the time length of a quarter note. The performance tempo can be changed also via a tempo operator (not shown) included in a group of setting operators.

Upon powering-on of the auto player piano 1, the automatic performance program of the control device 26 is started up. At step S110 of FIG. 8, the control device 26 determines, on the basis of the automatic performance program, whether no automatic performance is currently being executed (i.e., automatic performance is currently OFF). If no automatic performance is currently being executed as determined at step S110, the control device 26 proceeds to step S120. If any automatic performance is currently being executed as determined at step S110, the control device 26 branches to step S111, where the control device 26 adds a value "1" to the timing clock TCL and then goes to step S140.

At step S120, the control device 26 determines whether or not any automatic performance start instruction has been received from the operation panel 25 (FIG. 3) or the like. If any automatic performance start instruction has been received as determined at step S120, the control device 26 proceeds to step S130. If no automatic performance start instruction has been received as determined at step S120, on the other hand, the control device 26 branches to step S115, where the control device 26 receives any other operation than the automatic performance start instruction and performs control corresponding to the received operation. After that, the control device 26 goes to step S120. At step S130, the control device 26 not only resets the timing clock TCL to "0" but also starts an automatic performance, after which it proceeds to step S140.

At step S140, the control device 26 determines whether there is any event data corresponding to the current timing clock TCL. If there is any event data corresponding to the current timing clock TCL as determined at step S140, the control device 26 proceeds to step S150. If there is no event data corresponding to the current timing clock TCL as determined at step S140, on the other hand, the control device 26 goes to step S170. At step S150, the control device 26 performs an event process in accordance with the event data, and the electronic tone generation device 22 generates a tone for each tone generation event of a tone color other than a piano. After step S150, the control device 26 proceeds to step S160.

At step S160, the control device 26 determines whether there is no other event data corresponding to the current timing clock TCL. If there is any other event data corresponding to the current timing clock TCL as determined at step S160 (NO determination at step S160), the control device 26 branches to step S150. If there is no other event data corresponding to the current timing clock TCL as determined at step S160 (YES determination at step S160), on the other hand, the control device 26 proceeds to step S170.

At step S170, the control device 26 determines whether there is any key operating data corresponding to the current timing clock TCL. If there is any key operating data corresponding to the current timing clock TCL as determined at step S170, the control device 26 proceeds to step S200. If there is no key operating data corresponding to the current timing clock TCL as determined at step S170, on the other hand, the control device 26 jumps to step S190.

Figure 9:
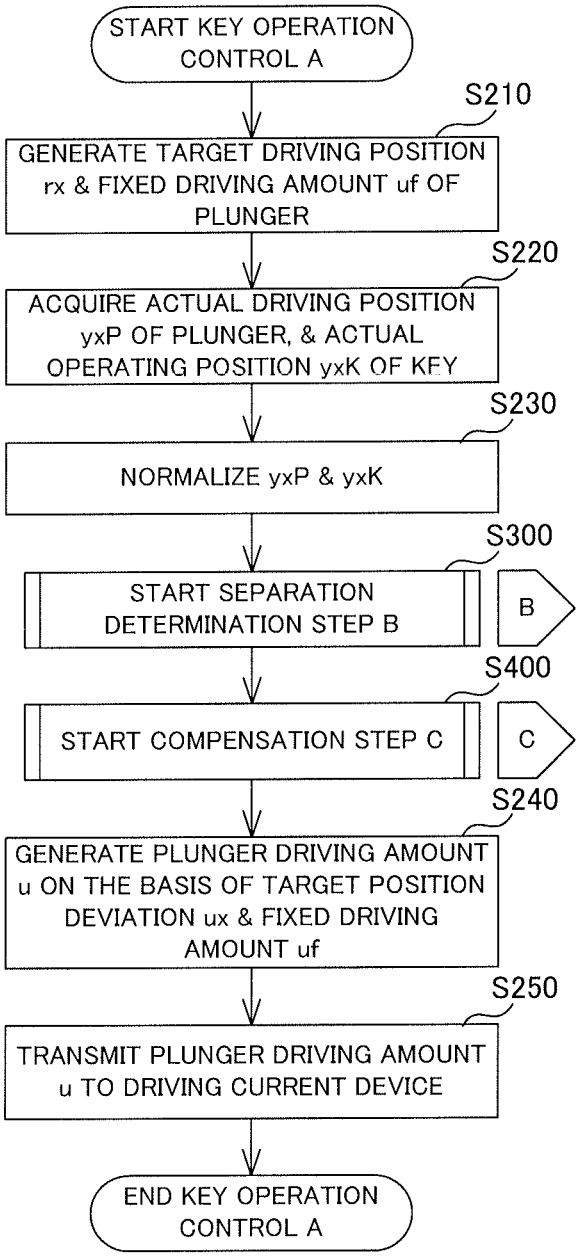
FIG. 9 is a flow chart showing details of a key operation control program in the first embodiment of the keyboard musical instrument of the present invention.

At step S200, the control device 26 starts key operation control A, where it first goes to step S210 (see FIG. 9). Upon completion of the key operation control A, the control device 26 proceeds to step S180.

At step S180, the control device 26 determines whether there is no other key operating data corresponding to the current timing clock TCL. If there is any other key operating data corresponding to the current timing clock TCL as determined at step S180, the control device 26 goes to step S200. If there is no other key operating data corresponding to the current timing clock TCL as determined at step S180, the control device 26 proceeds to step S190.

At step S190, the control device 26 determines whether or not the operation event data corresponding to the current timing clock TCL is end data. If the operation event data corresponding to the current timing clock TCL is end data as determined at step S190, the control device 26 ends the process of FIG. 8 to end the automatic performance. If the operation event data corresponding to the current timing clock TCL is not end data as determined at step S190, on the other hand, the control device 26 reverts to step S110.

The following describe in detail, with reference to FIG. 9, the aforementioned key operation control A performed at step S200 of the automatic performance program. At step S210 of FIG. 9, the control device 26 generates a target driving position rx and fixed driving amount of of the plunger 16*a* on the basis of the key operating data, as a driving information generation step. After step S210, the drive device 26 proceeds to step S220. At step S220, the control device 26 acquires an actual driving position yxP of the plunger 16*a* from the plunger sensor 17 (plunger sensor signal conversion device 20) and acquires an actual operating position yxK of the key 2 from the key sensor 18 (key sensor signal conversion device 21). After step S220, the control device 26 proceeds to step S230, where the control device 26 normalizes the acquired actual driving position yxP of the plunger 16*a* and actual operating position yxK of the key 2. After step S230, the control device 26 proceeds to step S300.

Figure 10:
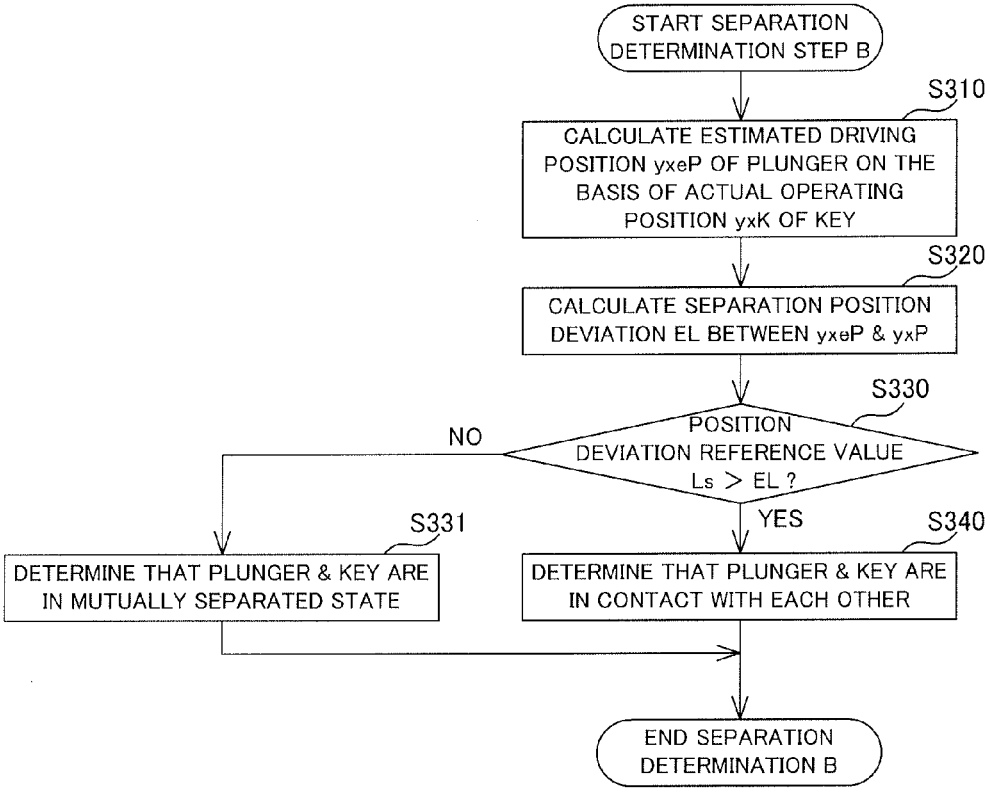
FIG. 10 is a flow chart showing details of a control program for determining separation between the key and the movable member of the actuator in the first embodiment of the keyboard musical instrument of the present invention.

At step S300, the control section 26 starts the separate determination step B, where it first goes to step S310 (FIG. 10). Upon completion of the separation determination step B, the control device 26 proceeds to step S400.

Figure 11:
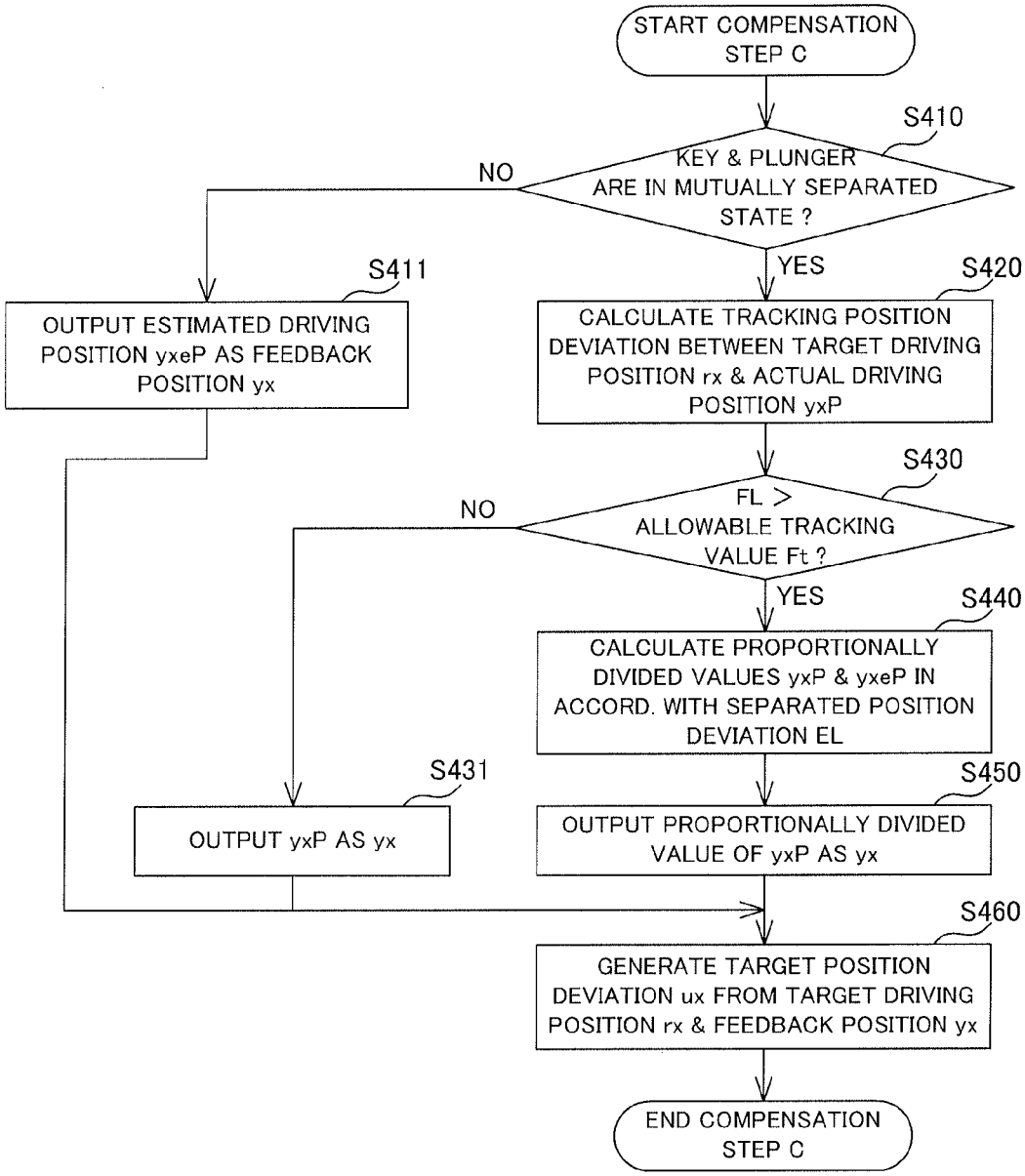
FIG. 11 is a flow chart showing control for correcting the target driving position of the movable member of the actuator in the first embodiment of the keyboard musical instrument of the present invention.

At step S400, the control section 26 starts the compensation step C, where it first goes to step S410 (FIG. 11). Upon completion of the compensation step C, the control device 26 proceeds to step S240.

At step S240, the control device 26 generates a plunger driving amount u by adding the fixed driving amount of of the plunger 16*a* to a target position deviation ux generated at the compensation step C and then proceeds to step S250. At step S250, the control device 26 transmits the plunger driving amount u to the driving current generation device 19, after which the control device 26 ends the key operation control A and then goes to step S180 (see FIG. 8).

The following describe in detail, with reference to FIG. 10, the aforementioned separation determination step B performed at step S300 of the automatic performance program. As shown in FIG. 10, at step S310, the control device 26 calculates an estimated driving position yxeP of the plunger 16*a* on the basis of the actual operating position yxK of the key 2. Then, the control device 26 proceeds to step S320, where the control device 26 calculates a separated position deviation EL between the estimated driving position yxeP of the plunger 16*a* and the actual driving position yxP of the plunger 16*a*. After step S320, the control device 26 proceeds to step S330.

At step S330, the control device 26 determines whether or not the calculated separated position deviation EL is less than a position deviation reference value Ls. If the calculated out-of-contact position deviation EL is less than the position deviation reference value Ls as determined at step S330, the control device 26 proceeds to step S340. If the calculated separated position deviation EL is not less than the position deviation reference value Ls as determined at step S330, on the other hand, the control device 26 branches to step S331, where the control device 26 determines that the key 2 and the plunger 16*a* are currently out of contact with each other, i.e. in the mutually separated state, and then ends the separation determination step B. After that, the control device 26 proceeds to step S400 of FIG. 9.

The control device 26 determines, at step S340, that the key 2 and the plunger 16*a* are currently in contact with each other, and then proceeds to the proceeds to step S400 (FIG. 9).

The following describe in detail, with reference to FIG. 11, the aforementioned compensation control C of the automatic performance program performed step 400. A shown in FIG. 11, the control device 26 determines at step S410 whether or not the key 2 and the plunger 16*a* are currently in the mutually separated state. If the key 2 and the plunger 16*a* are currently in the mutually separated state as determined at step S410, the control device 26 proceeds to step S420. If the key 2 and the plunger 16*a* are not currently in the mutually separated state as determined at step S410, the control device 26 branches to step S411. At step S411, the control section 26 outputs the estimated driving position yxeP of the plunger 16*a* as the feedback position yx and then proceeds to step S460.

The control device 26 calculates a tracking position deviation FL between the target driving position rx and actual driving position yxP of the plunger 16*a* at step S420, after which the control device 26 proceeds to step S430.

At step S430, the control device 26 determines whether or not the tracking position deviation FL is more than the allowable tracking value Ft. If the tracking position deviation FL is more than the allowable tracking value Ft as determined at step S430, the control device 26 proceeds to step S440. If the tracking position deviation FL is not more than the allowable tracking value Ft as determined at step S430, on the other hand, the control device 26 branches to step S431. The control device 26 outputs the actual driving position yxP as the feedback position yx at step S431, after which it proceeds to step S460.

The control device 26 calculates, at step S440, proportionally divided values of the actual driving position yxP and estimated driving position yxeP of the plunger 16*a* in accordance with the separated position deviation E, after the control device 26 proceeds to step S450. At step S450, the control device 26 outputs the proportionally divided value of the actual driving position yxP of the plunger 16*a* as the feedback position yx.

At step S460 following step S450, the control device 26 subtracts the feedback position yx from the target driving position rx of the plunger 16*a* to thereby generate a target position deviation ux. After step S460, the control device 26 ends the compensation step C and goes to step S240 (FIG. 9).

The auto player piano 1 constructed in the aforementioned manner makes the separation determination to determine whether or not the key 2 and the plunger 16*a* are currently in the mutually separated state (out of contact with each other), during execution of the automatic performance program, on the basis of the separated position deviation EL between the estimated driving position yxeP of the plunger 16*a* and the actual driving position yxP of the plunger 16*a*. If the key 2 and the plunger 16*a* are currently in contact with each other as determined through the separation determination, the auto player piano 1 performs servo control by feeding a feedback position yx, generated on the basis of the actual operating position yxK of the key 2, back to the target position deviation ux. If the key 2 and the plunger 16*a* are currently in the mutually separated state as determined through the separation determination, the auto player piano 1 performs servo control by feeding a feedback position yx, generated on the basis of at least the actual driving position yxP of the plunger 16*a* that is positively controllable, back to the target position deviation ux. Namely, at the moment when the key 2 and the plunger 16*a* come into the mutually separated state, the servo control changes from the control based on the estimated driving position yxeP of the plunger 16*a* to the control based on at least the actual driving position yxP of the plunger 16*a* so that the separation of the key 2 and the plunger 16*a* is not fixed but eliminated as soon as possible. In this manner, the auto player piano 1 drives the solenoid 16 in accordance with the driving information so that the key 2 and the plunger 16*a* are maintained in contact with each other as much as possible, and thus, the auto player piano 1 can execute a stable and accurate automatic performance while minimizing generation of driving noise. Whereas, in the instant embodiment, the feedback of the feedback position yx is performed on the target driving position rx, the present invention is not so limited, and servo control may be performed based on feedback of velocity and/or acceleration. Furthermore, whereas the auto player piano 1 has been described above in relation to the case where the key sensor 18 and the plunger sensor 17 are each in the form of a position sensor, the present invention is not so limited, and the key sensor 18 and the plunger sensor 17 may be in the form of any other types of elements as long as they can detect or calculate an actual operating position yxK or actual operating velocity yvK of the key 2 and an actual driving position yxP or actual driving velocity yvK of the plunger 16*a*.

Second Embodiment

Next, with reference to FIGS. 8 and 12 to 20, a description will be given about an auto player piano (auto playing piano) 30 (FIG. 12) that is a keyboard musical instrument according to a second of the present invention. In the following description about the second embodiment, the same or similar elements as or to those in the above-described first embodiment are depicted by the same reference numerals as used for the first embodiment and will not be described in detail here to avoid unnecessary duplication; namely, the following description about the second embodiment will focus mainly on different features of the second embodiment from the first embodiment.

Figure 12:
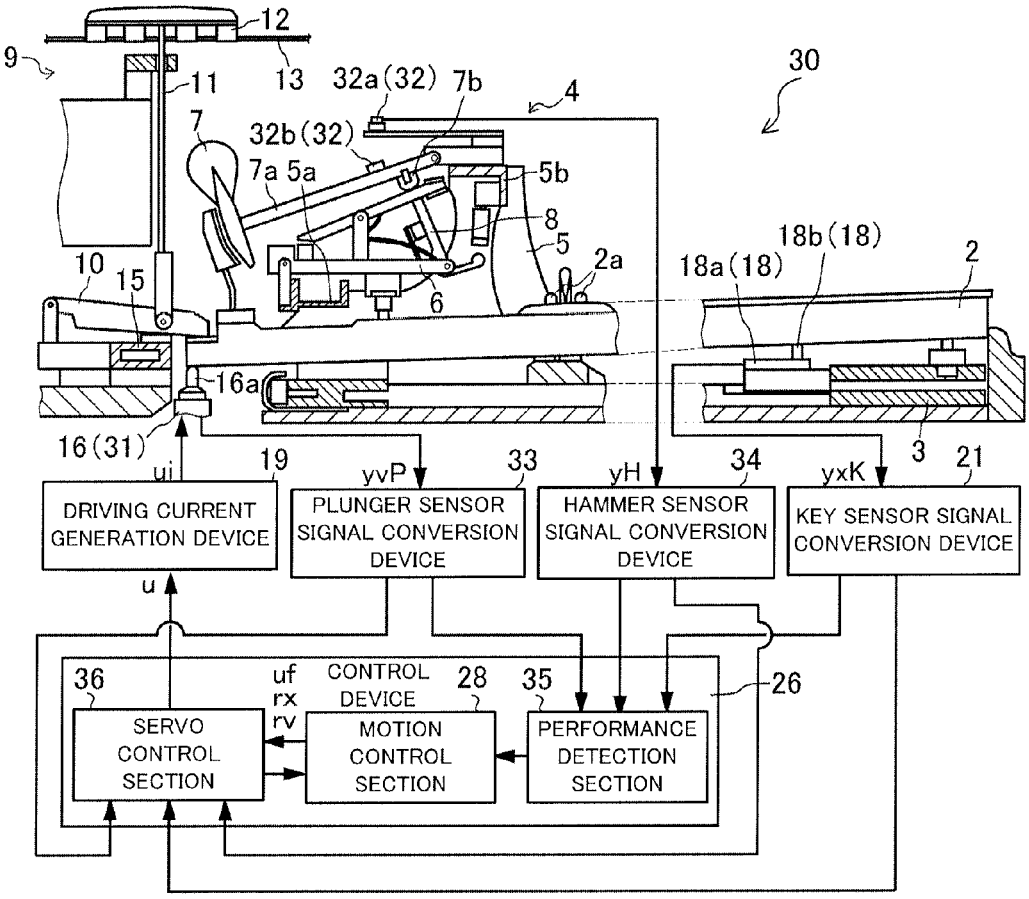
FIG. 12 is a schematic diagram showing constructions of a drive mechanism and a control device for automatic performance execution in a second embodiment of the keyboard musical instrument of the present invention.

As shown in FIG. 12, the auto player piano 30 includes, for each of the keys 2, the key sensor 18 in the form of a position sensor, a plunger sensor 31 in the form of a velocity sensor, and a hammer sensor 32 in the form of a position sensor. The plunger sensor 31 continuously detects an actual driving velocity yvP of the plunger 16*a* during ascending or descending motion of the plunger 16*a*. Each of the solenoids 16 has such a plunger sensor 31 incorporated therein so that the plunger sensor 31 detects the actual driving velocity yvP of the plunger 16*a* on the basis of variation of induced electromotive force of a not-shown solenoid coil. The plunger sensor 31 outputs the thus-detected actual driving velocity yvP as an analog signal. Note that the plunger sensor 31 is not limited to the above-mentioned construction and may be of any other constructions as long as it is capable of detecting the actual driving velocity yvP of the plunger 16*a*.

The hammer sensor 32, which detects displacement of the hammer shank 7*a*, is for example in the form of a magnetic type proximity sensor or optical position sensor. The hammer sensor 32 includes a sensor body 32*a* and a detected member 32*b*, and the sensor body 32*a* is provided on the shank rail 5*b* while the detected member 32*b* is provided on the hammer shank 7*a*. The hammer sensor 32 outputs a detection signal when the hammer 7 (hammer shank 7*a*) is at a predetermined position. Note that the hammer sensor 32 may be constructed to output a detection signal corresponding to a position of the hammer 7 in a similar manner to the key sensor 8.

Figure 13:
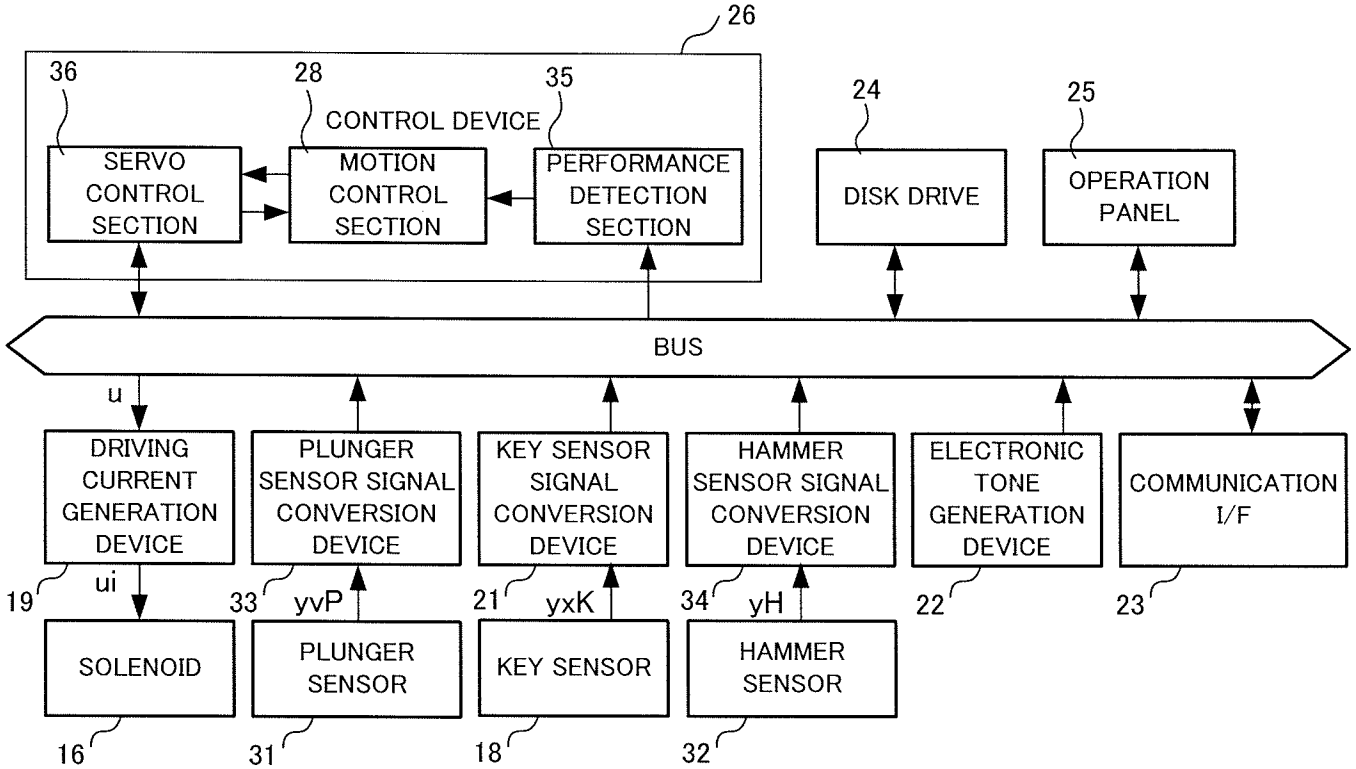
FIG. 13 is a block diagram showing controlling arrangements in the second embodiment of the keyboard musical instrument of the present invention.

Further, as shown in FIGS. 12 and 13, plunger sensor signal conversion devices 33, each for converting an analogue signal to a digital signal, are provided in corresponding relation to the plunger sensors 31 and connected to the corresponding plunger sensors 31. More specifically, each of the plunger sensor signal conversion devices 33 converts an analog signal indicative of the actual driving velocity yvP, output from the corresponding plunger sensor 31, into a digital signal. The plunger sensor signal conversion devices 33 are constructed to be capable of converting the analog signals, output from the corresponding plunger sensors 31 and indicative of the actual driving positions yxP of the corresponding plungers 16*a*, into digital signals indicative of the actual driving positions yxP independently of one another.

Hammer sensor signal conversion devices 34, each for converting an analogue signal to a digital signal, are provided in corresponding relation to the hammers 32 and connected to the corresponding hammers 32. More specifically, each of the hammer sensor signal conversion devices 34 converts an analog signal indicative of a hammer position yH, output from the corresponding hammer sensor 34, into a digital signal. The hammer sensor signal conversion devices 34 are constructed to be capable of converting the analog signals, output from the corresponding hammer sensors 32 and indicative of the hammer positions yH, into digital signals indicative of the hammer positions yH independently of one another.

A performance detection section 35 generates information about motion of the keys 2, hammers 7 and solenoids 16. The performance detection section 35 time-serially generates information, such as the hammer position yH converted into the digital signal by the hammer sensor signal conversion device 34. The performance detection section 35 transmits the thus-generated motion information of the hammer 7 to the motion control section 28.

A servo control section 36 generates a plunger driving amount u of the solenoid 16. The servo control section 36 acquires the digital signal indicative of the actual operating position yxK of the key 2 from each of the key sensor signal conversion devices 21, acquires the digital signal indicative of the actual driving velocity yvP of the plunger 16*a* from each of the plunger sensor signal conversion devices 33 and acquires the digital signal indicative of the hammer position yH from each of the hammer sensor signal conversion devices 34.

As shown in FIG. 13, the control device 26 is connected via a bus to the plurality of plunger sensor signal conversion devices 33 corresponding to the individual plunger sensors 31 and to the plurality of hammer sensor signal conversion devices 34 corresponding to the individual hammer sensors 32. The performance detection section 35 and servo control section 36 of the control device 26 can acquire, from each of the individual plunger sensor signal conversion devices 33, the digital signals indicative of the actual driving velocities yvP of the plungers 16*a* and acquire, from the individual hammer sensor signal conversion devices 34, the digital signals indicative of the hammer positions yH.

Figure 14:
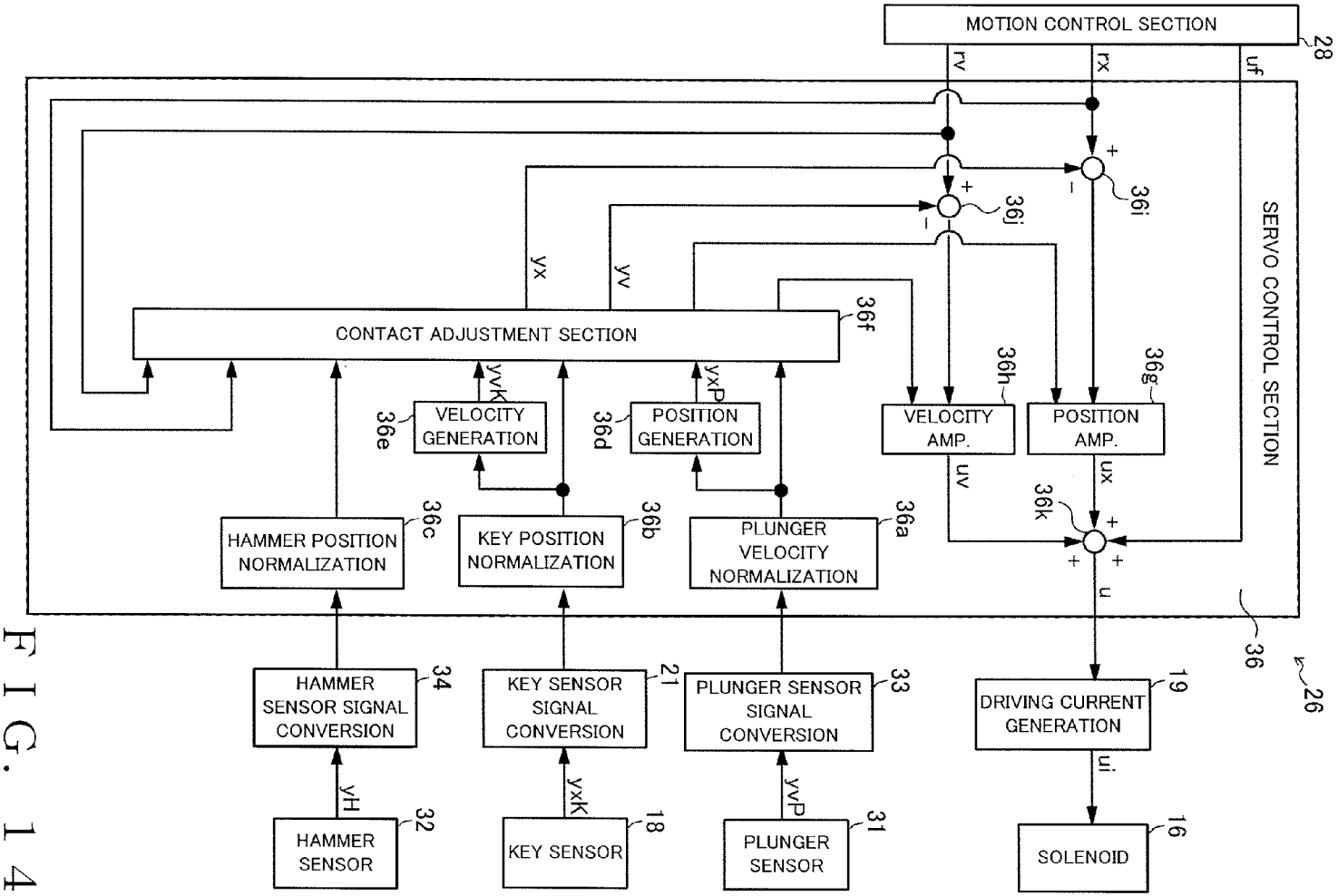
FIG. 14 is a schematic diagram showing a manner in which signals are transmitted from the control device in the second embodiment of the keyboard musical instrument of the present invention.
Figure 15:
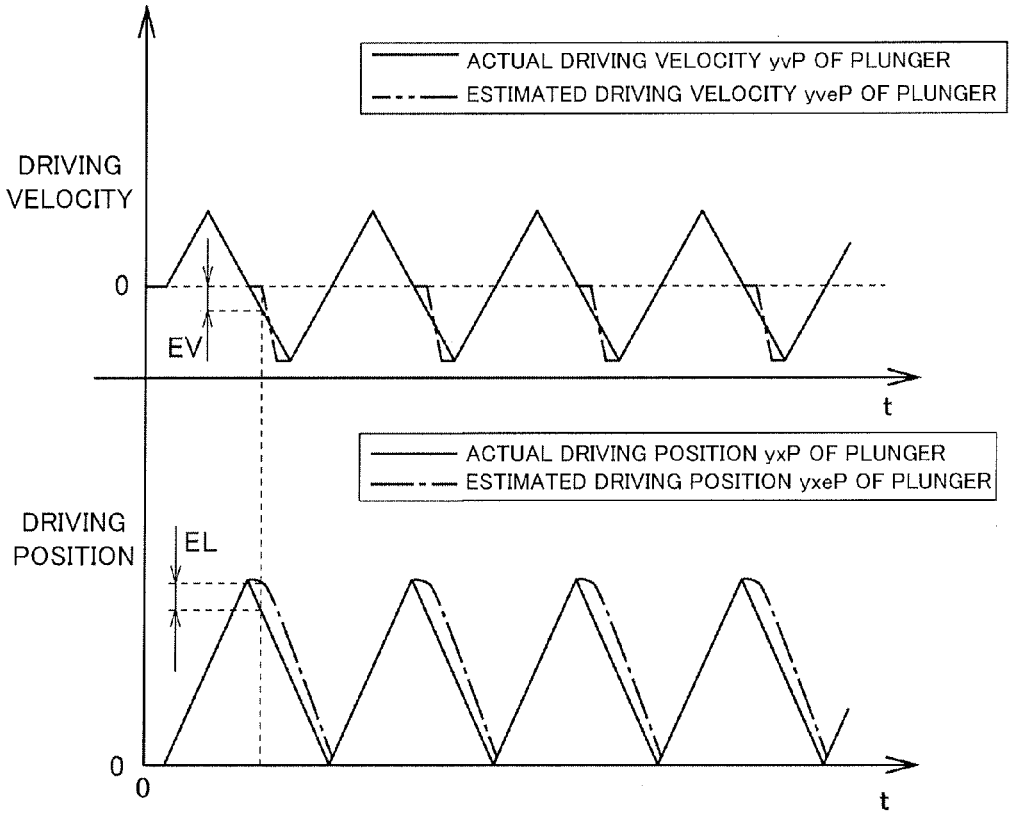
FIG. 15 is a diagram showing a manner in which a key and a movable member of an actuator operate in terms of their positions and velocities during consecutive hitting of a single key in the second embodiment of the keyboard musical instrument of the present invention.

The following describe, with reference to FIGS. 14 and 15, generation of the plunger driving amount u by the servo control section 36 of the control device 26. As shown in FIG. 14, the servo control section 36 includes a plunger velocity normalization section 36*a*, a key position normalization position 36*b*, a hammer position normalization section 36*c*, a position generation section 36*d*, a velocity generation section 36*e*, a contact adjustment section 36*f*, a position amplification section 36*g*, and a velocity amplification section 36*h*. The plunger velocity normalization section 36*a* acquires, from the plunger sensor signal conversion device 33, the digital signal indicative of the actual driving velocity yvP of the plunger 16*a* and performs a predetermined normalization process on the acquired digital signal indicative of the actual driving velocity yvP. Similarly, the hammer position normalization section 36*c* acquires, from the hammer sensor signal conversion device 34, the digital signal indicative of the hammer position yH and performs a predetermined normalization process on the acquired digital signal indicative of the hammer position yH.

The position generation section 36*d* generates an actual driving position yxP of the plunger 16*a*. More specifically, the position generation section 36*d* acquires the normalized actual driving velocity yvP of the plunger 16*a* from the plunger velocity normalization section 36*a* and then generates an actual driving position yxP of the plunger 16*a* through an integration process performed per unit time. Similarly, the velocity generation section 36*e* acquires the normalized actual operating position yxK of the key 2 from the position normalization section 36*d* and then generates an actual operating position yvK of the key 2 through a differentiation process performed per unit time.

Figure 16:
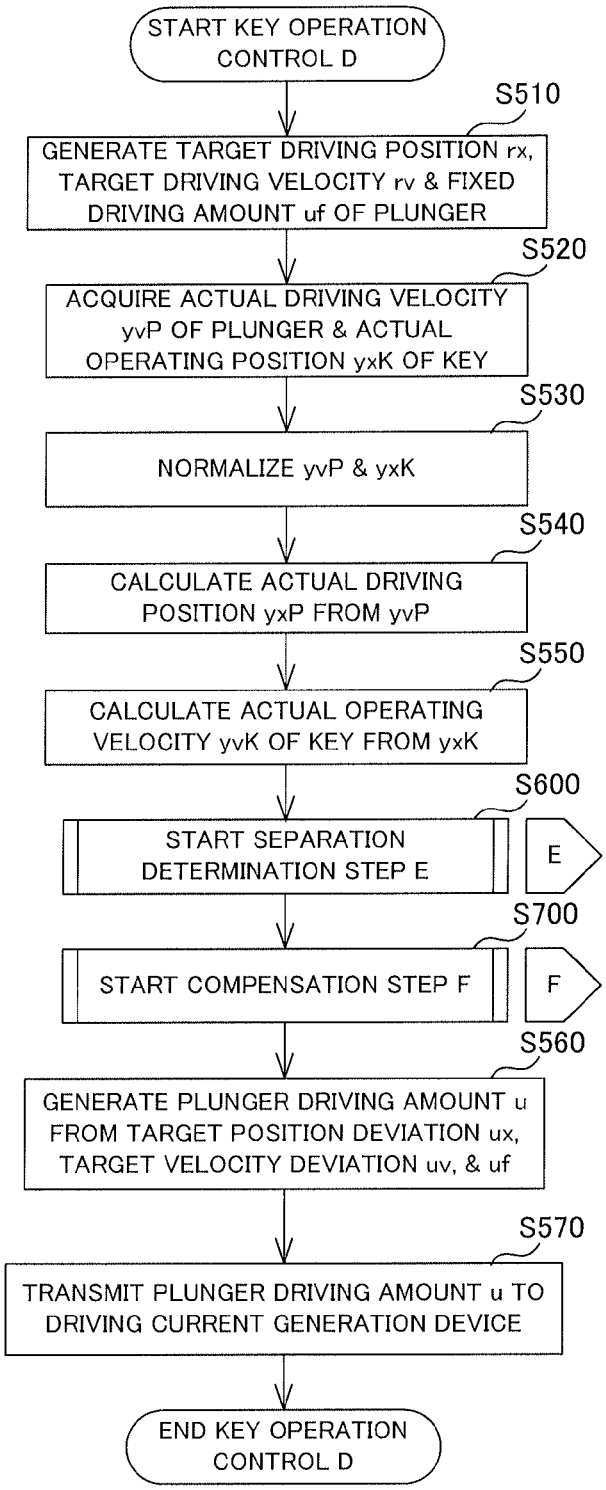
FIG. 16 is a flow chart showing details of a key operation control program in the second embodiment of the keyboard musical instrument of the present invention.

The contact adjustment section 36*f*, which is a determination means, not only determines, at the separation determination step of FIG. 16, whether or not the case where the key 2 and the plunger 16*a* are separated from each other by a relatively great distance, the key 2 and the plunger 16*a* of the solenoid 16 are currently out of contact with each other or currently in the mutually separated state, but also generates a feedback position yx and a feedback velocity yx (feedback information). More specifically, the contact adjustment section 36*f* acquires the actual driving position yvP of the plunger 16*a* normalized by the plunger velocity normalization section 36*a*, the actual driving position yxP of the plunger 16*a* generated by the position normalization section 36*d*, the actual operating position yxK of the key 2 generated by the key position normalization position 36*b*, the actual operating velocity yvK of the key 2 generated by the velocity generation section 36*e*, and the hammer position yH normalized by the hammer position normalization section 36*c*. Further, the contact adjustment section 36*f* acquires the target driving position rx and target driving velocity ry of the plunger 16*a* generated by the motion controller 28.

Further, FIG. 15 shows an example of relationship between the actual driving velocity yvP of the plunger 16*a* and an estimated driving velocity yveP of the plunger 16*a* determined from the actual operating position yxK (actual operating velocity yvK) of the key 2 when the single key 2 is hit consecutively (see an upper row of the figure), and an example of relationship between the actual driving position yxP of the plunger 16*a* and an estimated driving position yxeP of the plunger 16*a* determined from the actual operating position yxK of the key when the single key 2 is hit consecutively (see a lower row of the figure). The contact adjustment section 36*f* determines, at a separation determination step E (see FIG. 17), that the key 2 and the plunger 16*a* are maintained in contact with each other when a separated position deviation EL between the actual driving position yxP of the plunger 16*a* and the estimated driving position yxeP of the plunger 16*a* determined from the actual operating position yxK of the key 2 is less than a position deviation lower-limit reference value Lsd and an separation velocity deviation EV between the actual driving velocity yvP of the plunger 16*a* and the estimated driving velocity yveP of the plunger 16*a* determined from the actual operating velocity yvK of the key 2 is less than a velocity deviation reference value Vs. In this case, at a compensation step F (see FIG. 18), the contact adjustment section 36*f* not only outputs the estimated driving position yxeP of the plunger 16*a* as a feedback position yx to be fed back to the target driving position rx but also outputs the estimated driving velocity yveP of the plunger 16*a* as a feedback velocity yv to be fed back to the target driving velocity rv. Namely, when the key 2 and the plunger 16*a* are in contact with each other, a stable and accurate automatic performance can be executed through control of the plunger 16*a* based on the actual operating position yxk and actual operating velocity yvK of the key 2.

Further, the contact adjustment section 36*f* determines, at the separation determination step E (see FIG. 17), that the key 2 and the plunger 16*a* have started shifting from the mutually contacting state to the mutually separated state (i.e., the plunger 16*a* is about to move or separate away from the key 2) when the separation velocity deviation EV is equal to or more than the velocity deviation reference value Vs. More specifically, when respective velocities of the key 2 and the plunger 16*a* differ from each other in direction in such a manner as to satisfy relationships indicated by Mathematical Expression 1 and Mathematical expression 2 below and but the respective velocities of the key 2 and the plunger 16*a* differ from each other in intensity in such a manner as to satisfy relationships indicated by Mathematical Expression 1 and Mathematical Expression 3 below although the key 2 and the plunger 16*a* are currently in contact with each other, the contact adjustment section 36*f* determines that the key 2 and the plunger 16*a* have started shifting from the mutually contacting state to the mutually separated state.

$$yxP \approx yxeP \quad \text{(Mathematical Expression 1)}$$

$$\text{sign}(yvP) \neq \text{sign}(yveP) \quad \text{(Mathematical Expression 2)}$$

$$\text{sign}(yvP) = \text{sign}(yveP), \text{ where if } ry > 0, \text{ then } 0 < yvP \leq yveP, \text{ and if } ry < 0, \text{ then } 0 > yvP \geq yveP \quad \text{(Mathematical Expression 3)}$$

In this case, at the compensation step F (FIG. 18), the contact adjustment section 36*f* not only outputs the actual driving position yxP of the plunger 16*a* as the feedback position yx to be fed back to the target driving position rx but also outputs the actual driving velocity yvP of the plunger 16*a* as the feedback velocity yv to be fed back to the target driving velocity rv. Further, the contact adjustment section 36*f* reduces amplification factors (servo loop gains) of the position amplification section 36*g* and velocity amplification section 36*h* in accordance with the separation velocity deviation EV. Namely, in a state where the possibility that the key 2 and the plunger 16*a* will move away, i.e. separate, from each other is high although the plunger 16*a* is currently maintained at a position within a predetermined range from the target driving position rx, the separation between the key 2 and the plunger 16*a* is restrained through control of the plunger 16*a* with the actual driving position yxP and actual driving velocity yvP of the plunger 16*a* amplified appropriately, so that a stable automatic performance can be executed.

Further, at the separation determination step E (see FIG. 17), the contact adjustment section 36*f* determines that the plunger 17*a* and the key 2 are currently in the separated state, when the separated position deviation EL is equal to or more than the position deviation lower-limit reference value Lsd. In this case, at the compensation step F (FIG. 18), the contact adjustment section 36*f* not only outputs the actual driving position yxP of the plunger 16*a* as the feedback position yx to be fed back to the target driving position rx but also outputs the actual driving velocity yvP of the plunger 16*a* as the feedback velocity yv to be fed back to the target driving velocity rv, when the separated position deviation EL is equal to or more than a position deviation upper-limit reference value Lsu. Furthermore, the contact adjustment section 36*f* sets the amplification factors (servo loop gains) of the position amplification section 36*g* and velocity amplification section 36*h* at predetermined values. Namely, when the key 2 and the plunger 16*a* are separated from each other by a relatively great distance, it is assumed that the key 2 is in an unstable state, and thus, a stable automatic performance can be executed through control of the plunger 16*a* based on the actual driving position yxP of the plunger 16*a*.

Furthermore, at the compensation step F (FIG. 18), the contact adjustment section 36*f* not only outputs the estimated driving position yxeP of the plunger 16*a* as the feedback position yx to be fed back to the target driving position rx but also outputs the estimated driving velocity yveP of the plunger 16*a* as the feedback velocity yv to be fed back to the target driving velocity rv, when the separated position deviation EL is less than the position deviation upper-limit reference value Lsu. At that time, if the hammer position yH has reached a string (13) striking position within a predetermined time, the contact adjustment section 36*f* not only outputs the actual driving position yxP of the plunger 16*a* as the feedback position yx to be fed back to the target driving position rx but also outputs the actual driving velocity yvP of the plunger 16*a* as the feedback velocity yv to be fed back to the target driving velocity rv. Namely, when the key 2 and the plunger 16*a* are not separated from each other by a great distance, it is assumed that the key 2 is in a stable state, and thus, a stable automatic performance can be executed through control of the plunger 16*a* based on the actual operating position yxK of the key 2. Note, however, that the control of the plunger 16*a* is performed on the basis of the actual driving position yxP of the plunger 16*a* that is controllable reliably, because the positions of the key 2 and the plunger 16*a* are clearly detectable immediately after the striking of the string 13.

A subtractor 36*i* in FIG. 14 subtracts the above-mentioned feedback position yx from the target driving position rx to calculate a deviation of the feedback position relative to the target driving position (target position deviation). A subtractor 36*j* in FIG. 14 subtracts the feedback velocity yx from the target driving velocity ry to calculate a deviation of the feedback velocity relative to the target driving velocity (target velocity deviation). The position amplification section 36*g* amplifies the target position deviation, output from the subtractor 36*i*, with an amplification factor (servo loop gain) set as desired and then outputs the thus-amplified target position deviation as the target position deviation ux. The velocity amplification section 36*h* amplifies the target velocity deviation, output from the subtractor 36*j*, with an amplification factor (servo loop gain) set as desired and then outputs the thus-amplified target velocity deviation as the target velocity deviation uv. An adder 36*k* adds together the target position deviation ux output from the position amplification section 36*g*, the target velocity deviation uv output from the velocity amplification section 36*h* and the above-mentioned fixed driving amount of and then outputs the added result as a plunger driving amount u.

Figure 18:
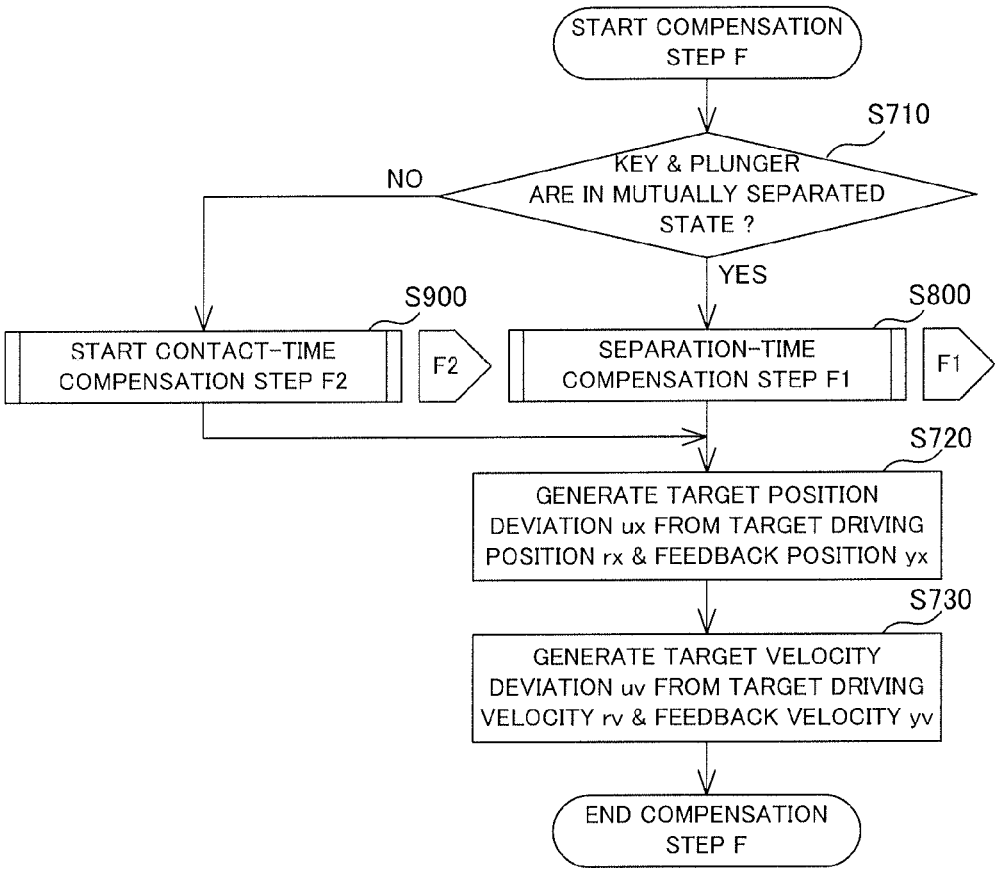
FIG. 18 is a flow chart showing control for correcting a target driving position of the movable member of the actuator in the second embodiment of the keyboard musical instrument of the present invention.

Namely, in the servo control section 36 constructed in the aforementioned manner, the contact adjustment section 36*f* makes the separation determination to determine whether or not the key 2 and the plunger 16*a* are currently in the mutually separated state, on the basis of the actual driving position yxP and actual driving velocity yvP of the plunger 16*a* and the actual operating position yxK and actual operating velocity yvK of the key 2 acquired through the separation determination step. Further, the contact adjustment section 36*f* generates the feedback position yx and feedback velocity yv based on the separation determination, through the compensation step F (FIG. 18). The servo control section 36 generates the target position deviation ux and target velocity deviation uv by subtracting the feedback position yx from the target driving position rx of the plunger 16*a* and subtracting the feedback velocity yv from the target driving velocity ry of the plunger 16*a*. The servo control section 36 generates the plunger driving amount u by adding together the target position deviation ux amplified by the position amplification section 36*g*, the target velocity deviation uv amplified by the velocity amplification section 36*h* and the fixed driving amount uf of the plunger 16*a*.

Figure 8:
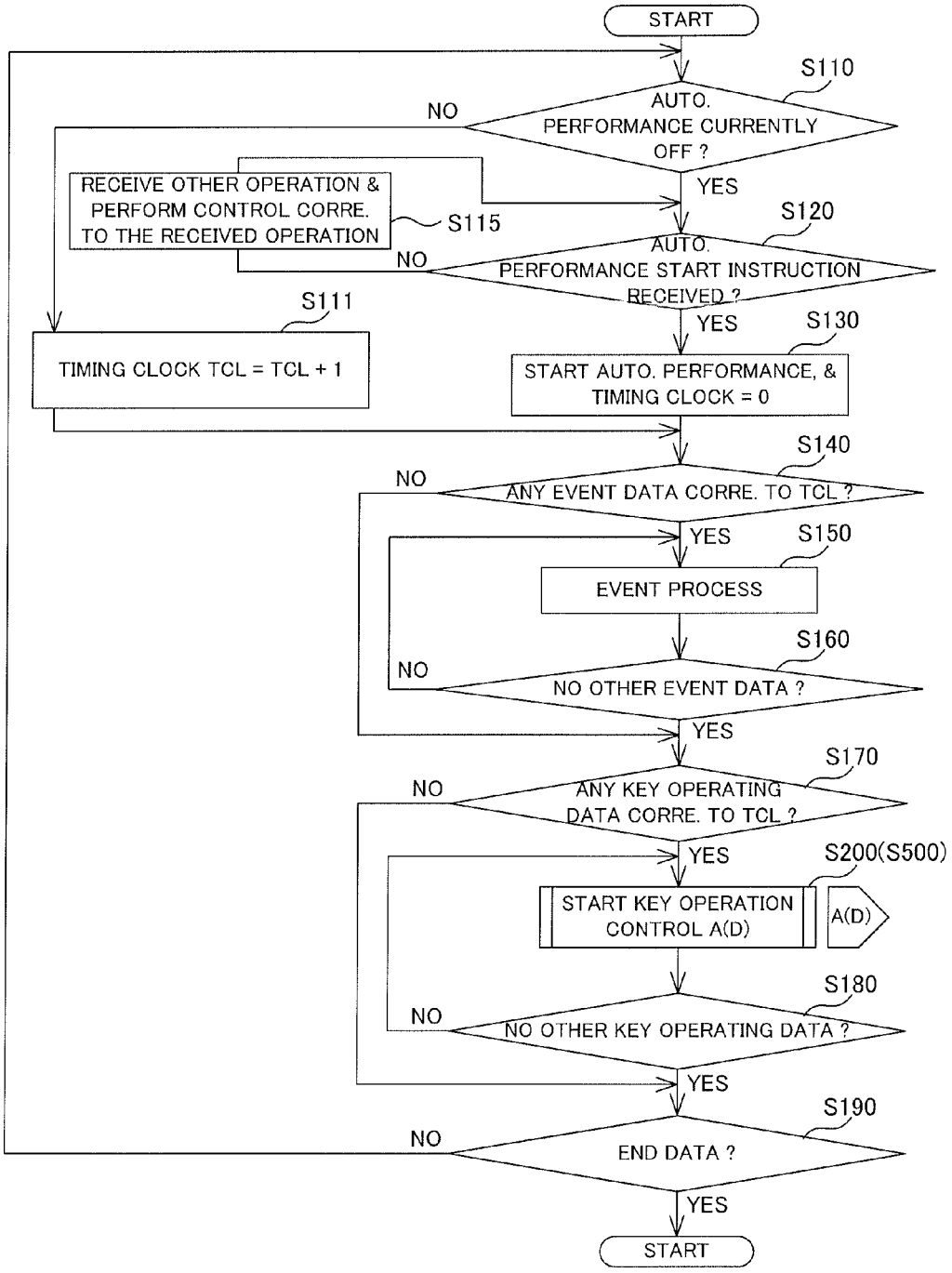
FIG. 8 is a flow chart showing details of an automatic performance control program in the first embodiment of the keyboard musical instrument of the present invention.

The following describe in detail, with reference to FIGS. 8 and 16 to 20, control performed in the auto player piano 30 that is the keyboard musical instrument according to the second embodiment of the present invention. In the second embodiment too, upon powering-on of the auto player piano 30, the automatic performance program of the control device 26 is started up, so that the control shown in FIG. 8 is performed. Note that, in the second embodiment, step S500 is performed in place of step S200 performed in the first embodiment.

The control device 26 starts key operation control D at step S500, where it first proceeds to step S510 of FIG. 16. Upon completion of the key operation control D, the control device 26 moves to step S180.

As shown in FIG. 16, the control device 26 generates a target driving position rx, target driving velocity ry and fixed driving amount uf of the plunger 16*a* on the basis of the key operating data at step S510, after which the control device 26 moves on to step S520. At step S520, the control device 26 acquires an actual driving velocity yvP of the plunger 16*a* from the plunger sensor 31 and acquires an actual operating position yxK of the key2 from the key sensor 18. At next S530, the control device 26 normalizes the actual driving velocity yvP of the plunger 16*a* and the actual operating position yxK of the key2.

At next step S540, the control device 26 calculates an actual driving position yxP of the plunger 16*a* by integrating the actual driving velocity yvP of the plunger 16*a*. At step S550 following step S540, the control device 26 calculates an actual driving velocity yvK of the key 2 by differentiating the actual operating position yxK of the key 2.

Figure 17:
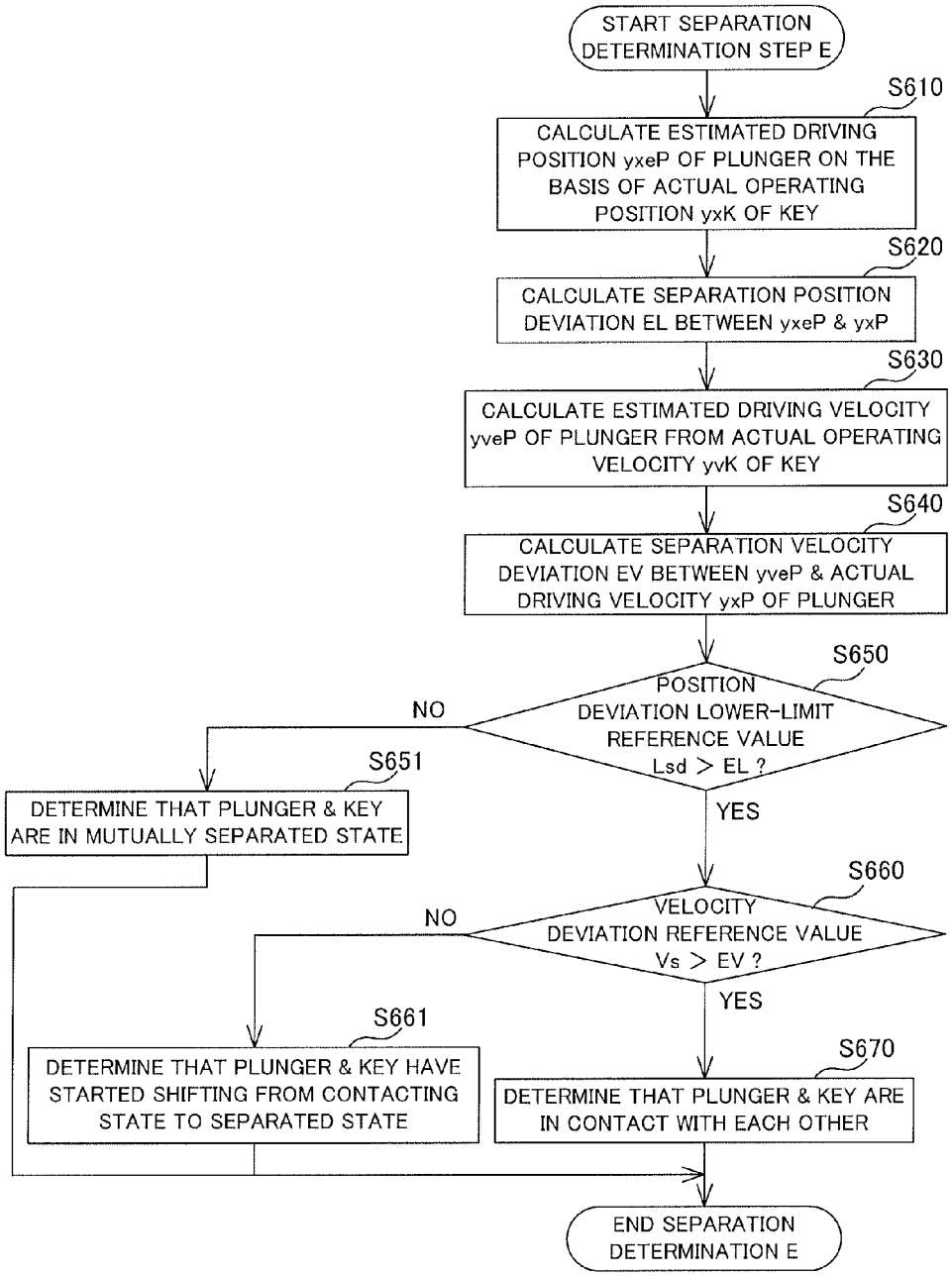
FIG. 17 is a flow chart showing details of a control program for determining separation between the key and the movable member of the actuator in the second embodiment of the keyboard musical instrument of the present invention.

At step S600 following step S550, the control device 26 starts the separation determination step E, where the control device 26 first proceeds to step S610 (see FIG. 17). Upon completion of the separation determination step E, the control device 26 proceeds to step S700 of FIG. 16.

At step S700, the control device 26 starts the compensation step F, where the control device 26 first proceeds to step S710 (FIG. 18). Upon completion of the compensation step F, the control device 26 proceeds to step S560 of FIG. 16.

At step S560, the control device 26 generates a plunger driving amount u by adding, to the target position deviation ux generated at the compensation step F, the target velocity deviation uv generated at the compensation step F and the fixed driving amount of of the plunger 16*a*. At step S570 following step S560, the control device 26 transmits the thus-generated plunger driving amount u to the driving current generation device 19. After that, the control device 26 ends the key operation control D and then proceeds to step S180 of FIG. 8.

The following describe in detail the separation determination step E at step S600 of the automatic performance program. At step S610 of FIG. 17, the control device 26 calculates an estimated driving position yxeP of the plunger 16*a* from the actual operating position yxK of the key 2. Then, the control device 26 goes to step S620, where the control device 26 calculates a separated position deviation EL between the estimated driving position yxeP and actual driving position yxP of the plunger 16*a*.

At step S630 following step S620, the control device 26 calculates an estimated driving velocity yvep of the plunger 16*a* from the actual operating velocity yvK of the key 2. Then, the control device 26 proceeds to step S640, where the control device 26 calculates a separation velocity deviation EV between the estimated driving velocity yveP and actual driving velocity yvP of the plunger 16*a*.

At step S650 following step S640, the control device 26 determines whether or not the separated position deviation EL er-limit reference value Lsd. If the separated position deviation EL is less than the position deviation lower-limit reference value Lsd as determined at step S650, the control device 26 proceeds to step S660. If the separated position deviation EL is not less than the position deviation lower-limit reference value Lsd, on the other hand, the control device 26 branches to step S651. The control device 26 determines at step S651 that the plunger 16*a* and the key 2 are currently in the mutually separated state, and then proceeds to step S700 of FIG. 16.

At step S660, the control device 26 determines whether or not the separation velocity deviation EV is less than the velocity deviation reference value Vs. If the separation velocity deviation EV is less than the velocity deviation reference value Vs as determined at step S660, the control device 26 proceeds to step S670. If the separation velocity deviation EV is not less than the velocity deviation reference value Vs as determined at step S660, on the other hand, the control device 26 branches to step S661, where the control device 26 determines that the key 2 and the plunger 16*a* have started shifting from the mutually contacting state to the mutually separated state and then ends the separation determination step E. After that, the control device 26 proceeds to step S700 of FIG. 16. At step S670, the control device 26 determines that the key 2 and the plunger 16*a* are currently in the mutually contacting state and then ends the separation determination step E. After that, the control device 26 proceeds to step S700 of FIG. 16.

The following describe in detail, with reference to FIG. 18, the compensation step F at step S700 of the automatic performance program. At step S710 of FIG. 18, the control device 26 determines whether or not the key 2 and the plunger 16*a* are currently in the mutually separated state. If the key 2 and the plunger 16*a* are currently in the mutually separated state as determined at step S710, the control device 26 proceeds to step S800. If the key 2 and the plunger 16*a* are not currently in the mutually separated state as determined at step S710, on the other hand, the control device 26 branches to step S900.

Figure 19:
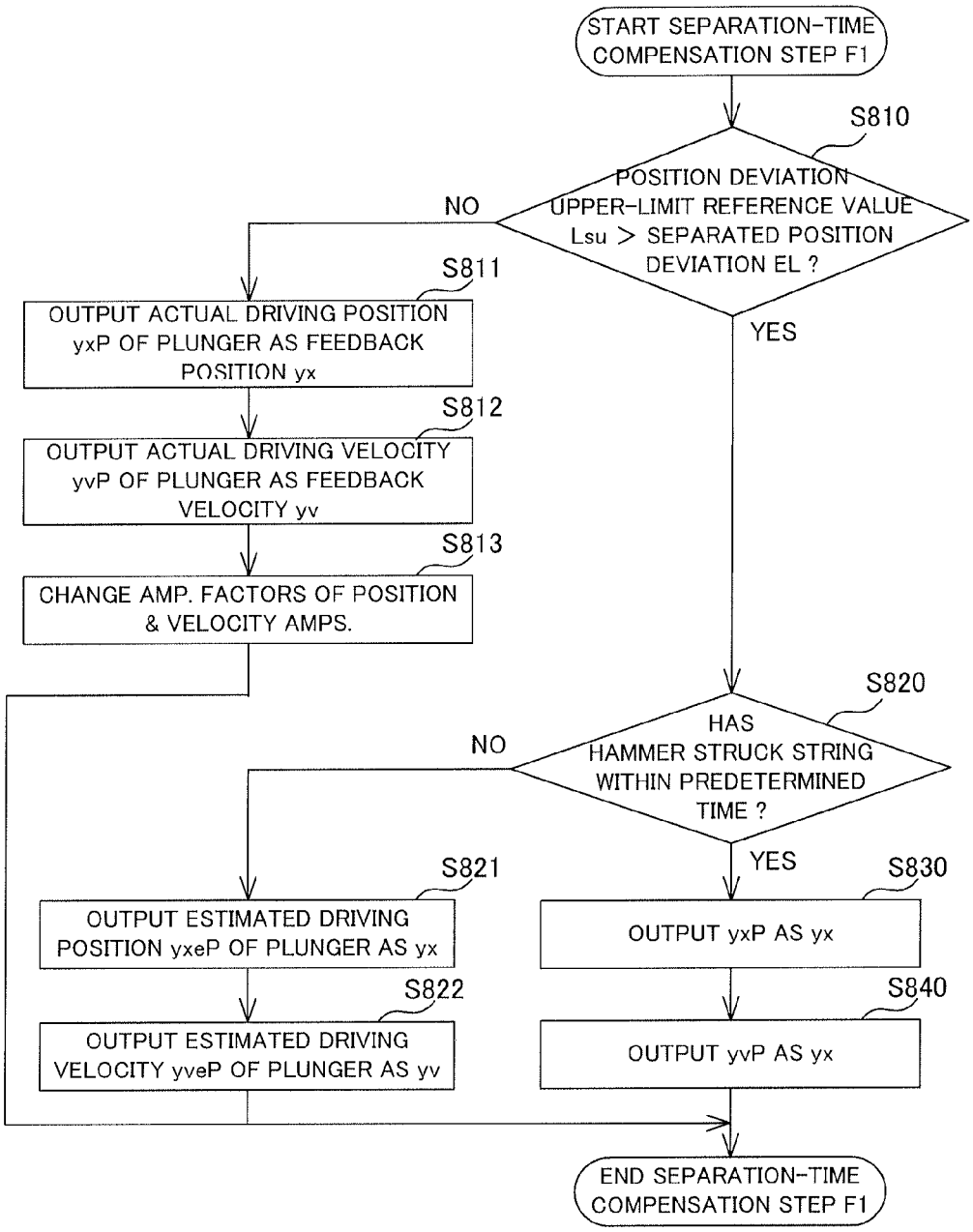
FIG. 19 is a flow chart showing details of a control program for correcting a target driving position and target driving velocity of the movable member of the actuator in the second embodiment of the keyboard musical instrument of the present invention.

The control device 26 starts a separation time compensation step F1 at step S800, where the control device 26 first proceeds to step S810 of FIG. 19. Upon completion of the separation time compensation step F1, the control device 26 proceeds to step S720 of FIG. 18.

Figure 20:
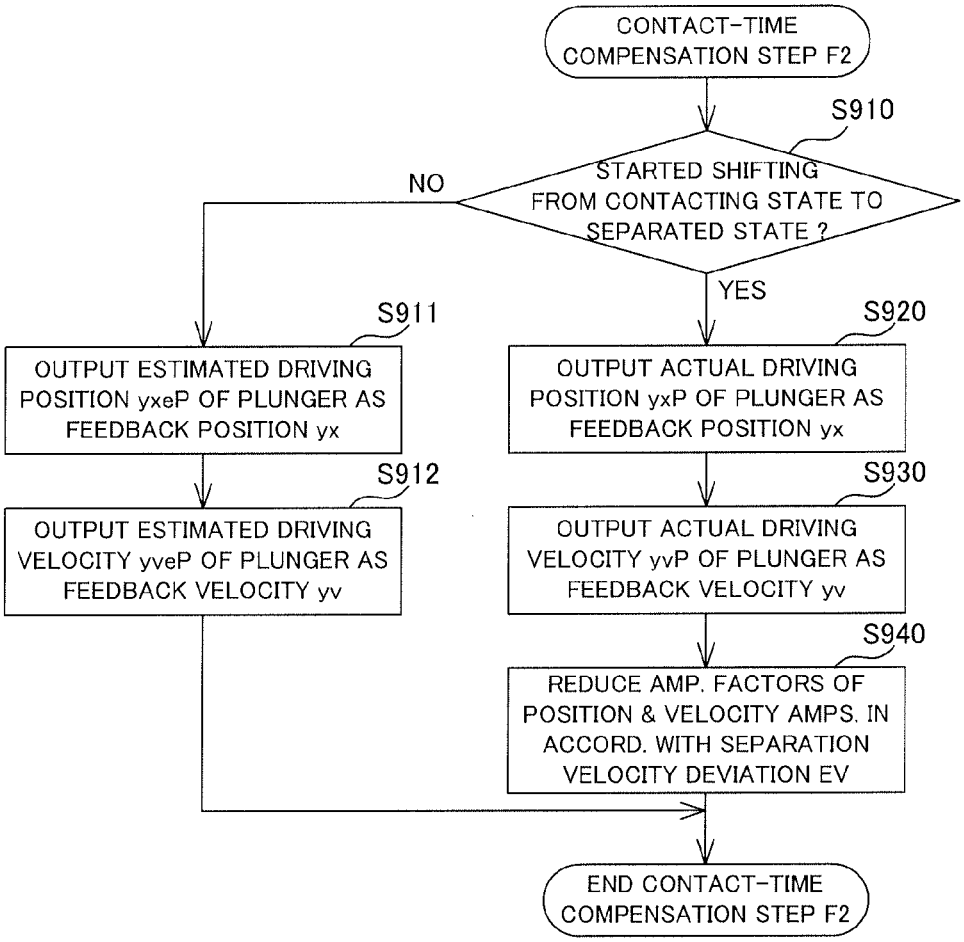
FIG. 20 is a flow chart showing details of a control program for calculating a feedback position and feedback velocity when the key and the movable member of the actuator are out of contact, i.e. separated, from each other.

The control device 26 starts a contact time compensation step F2 at step S900, where the control device 26 first proceeds to step S910 of FIG. 20. Upon completion of the contact time compensation step F2, the control device 26 proceeds to step S720.

At step S720, the control device 26 generates a target position deviation ux by subtracting the feedback position yx from the target driving position rx of the plunger 16*a*. At step S730 following step S720, the control device 26 generates a target velocity deviation uv by subtracting the feedback velocity yv from the target driving velocity ry of the plunger 16*a*. After that, the control device 26 ends the compensation step F and then proceeds to step S560 of FIG. 16.

The following describe in detail, with reference to FIG. 19, the separation time compensation step F1 at step S800 of the automatic performance program. At step S810 of FIG. 19, the control device 26 determines whether or not the separated position deviation EL is less than the position deviation upper-limit reference value Lsu. If the position deviation EL is less than the position deviation upper-limit reference value Lsu as determined at step S810, the control device 26 proceeds to step S820. If the position deviation EL is not less than the position deviation upper-limit reference value Lsu as determined at step S810, on the other hand, the control device 26 branches to step S811. The control device 26 outputs the actual driving position yxP of the plunger 16*a* as the feedback position yx at step S811, after which the control device 26 proceeds to step S812. The control device 26 outputs the actual driving velocity yvP of the plunger 16*a* as the feedback velocity yv at step S812, after which the control device 26 proceeds to step S813. At step S813, the control device 26 sets the amplification factors (servo loop gains) of the position amplification section 36*g* and velocity amplification section 36*h* at respective instructed values. After that, the control device 26 ends the separation time compensation step F1 and then proceeds to step S720 of FIG. 18.

At step S820, the control device 26 determines whether or not the hammer 7 has struck the string 13 within a predetermined time, i.e. whether or not the hammer position yH has reached the string striking position within a predetermined time. If the hammer 7 has struck the string 13 within the predetermined time as determined at step S820, the control device 26 proceeds to step S830. If the hammer 7 has not struck the string 13 within the predetermined time as determined at step S820, on the other hand, the control device 26 branches to step S821. The control device 26 outputs the estimated driving position yxeP of the plunger 16*a* as the feedback position yx at step S821, after which the control device 26 proceeds to step S822. At step S822, the control device 26 outputs the estimated driving velocity yveP of the plunger 16*a* as the feedback velocity yv. After that, the control device 26 ends the separation time compensation step F1 and then proceeds to step S720 of FIG. 18.

At step S830 of FIG. 19, the control device 26 outputs the actual driving position yxP of the plunger 16*a* as the feedback position yx. After that, the control device 26 outputs the actual driving velocity yvP of the plunger 16*a* as the feedback velocity yv at next step S840. Then, the control device 26 ends the separation time compensation step F1 and then proceeds to step S720 of FIG. 18.

The following describe in detail, with reference to FIG. 20, the contact time compensation step F2 at step S900 of the automatic performance program. At step S910, the control device 26 determines whether or not the key 2 and the plunger 16*a* have started shifting from the mutually contacting state to the mutually separated state. If the key 2 and the plunger 16*a* have started shifting from the mutually contacting state to the mutually separated state as determined at step S910, the control device 26 proceeds to step S920. If the key 2 and the plunger 16*a* have not yet started shifting from the mutually contacting state to the mutually separated state as determined at step S910, on the other hand, the control device 26 branches to step S911. The control device 26 outputs the estimated driving position yxeP of the plunger 16*a* as the feedback position yx at step S911, after which the control device 26 proceeds to step S912. The control device 26 outputs the estimated driving velocity yveP of the plunger 16*a* as the feedback velocity yv at step S912. After that, the control device 26 ends the contact time compensation step F2 and then proceeds to step S720 of FIG. 18.

The control device 26 outputs the actual driving position yxP of the plunger 16*a* as the feedback position yx at step S920, after which the control device 26 proceeds to step S930. The control device 26 outputs the actual driving velocity yvP of the plunger 16*a* as the feedback velocity yv at step S930, after which the control device 26 proceeds to step S940. At step S940, the control device 26 reduces the amplification factors (servo loop gains) of the position amplification section 36*g* and velocity amplification section 36*h* in accordance with the separation velocity deviation EV calculated at the separation determination step E. After that, the control device 26 ends the contact time compensation step F2 and then proceeds to step S720 of FIG. 18.

Because the auto player piano 30 constructed in the aforementioned manner makes the separation determination, during execution of the automatic performance program, to determine whether or not the key 2 and the plunger 16*a* are currently in the mutually separated state, on the basis of not only the separated position deviation EL between the key 2 and the plunger 16*a* but also the separation velocity deviation EV between the key 2 and the plunger 16*a*, the separation determination can be made more appropriately. Further, for each of the case where the key 2 and the plunger 16*a* are currently in the mutually contacting state, the case where the key 2 and the plunger 16*a* are currently in the mutually contacting state but differ from each other in velocity, the case where the key 2 and the plunger 16*a* are separated from each other by a relatively great distance, the case where the key 2 and the plunger 16*a* are not separated from each other by a relatively great distance, the auto player piano 30 compensates the target driving position rx by feeding the feedback position yx back to the target driving position rx and compensates the target driving velocity ry by feeding the feedback velocity yv back to the target driving velocity rv, even more appropriate control of the plunger 16*a* can be performed. In this way, the auto player piano 30 can minimize generation of driving noise and execute a stable and accurate automatic performance. Note that, whereas the second embodiment has been described in relation to the case where the key sensor 18 in the auto player piano 30 is in the form of a position sensor and the plunger sensor 31 is in the form of a velocity sensor, the present invention is not so limited, and the key and plunger sensors 18 and 31 may be any desired elements as along as they can detect or calculate the actual operating position yxK and actual operating velocity yvK of the key 2 and the actual driving position yxP and actual driving velocity yvP of the plunger 16*a*. Further, whereas the second embodiment has been described in relation to the case where the feedback position yx and the feedback velocity yv are fed back to the target driving position rx and the target driving velocity rv, respectively, the present invention is not so limited, and compensation by feedback of acceleration may be performed.

Further, whereas the auto player piano 1 and the auto player piano 30 have been described above as embodiments applied to a grand piano, the present invention is not so limited, and the auto player pianos 1 and 30 may be applied to an upright piano or an electronic piano. Furthermore, whereas the auto player pianos 1 and 30 have been described as constructed so that the key 2 is operated by the solenoid 16, the present invention is not so limited, and the key 2 may be operated in any other manner. Furthermore, whereas the auto player pianos 1 and 30 have been described as constructed so that positional relationship between the key 2 and the plunger 16*a* is determined on the basis of positions and velocities of the key 2 and the plunger 16*a*, the present invention is not so limited, and a pressure sensor may be provided at a position where the key 2 and the plunger 16*a* contact each other, so that not only contact between the key 2 and the plunger 16*a* when the key 2 is driven by the plunger 16*a* can be detected via the pressure sensor but also separation between the key 2 and the plunger 16*a* can be detected via the pressure sensor. Alternatively, proximity and position sensors may be provided between the key 2 and the plunger 16*a* for detecting a distance and positional relationship between the key 2 and the plunger 16*a*. Furthermore, whereas the fixed driving amount uf has been described as being set at a constant value, the present invention is not so limited, and the fixed driving amount uf may be varied on the basis of the separated position deviation EL. Furthermore, the auto player pianos 1 and 30 may be constructed to vary the fixed driving amount uf, target driving position rx, feedback position yx, and feedback velocity yv in accordance with variation in the operating state of the key 2 responsive to operations of the loud pedal 14 and shift pedal 14. Furthermore, the auto player pianos 1 and 30 may be constructed to record the determination result of the separation between the key 2 and the plunger 16*a* into the key operating table DT (FIG. 7) and/or output in real time the determination result of the separation to the outside via the communication interface 23 etc. (FIG. 3).

Furthermore, whereas the musical instrument of the present invention has been described above as applied as keyboard musical instruments, such as the auto player pianos 1 and 30, the present invention is not so limited, and the musical instrument of the present invention may be one having a key 2 or any other type of performance operator with a solenoid 16 or any other type of actuator. Namely, the present invention is also applicable to musical instruments other than keyboard musical instruments. In such cases, the performance operator is not limited to a key and may be a member that operates a mechanism for driving a physical vibration source, such as a string, reed, pipe or vibrating element and that is automatically driveable by an actuator. Moreover, the above-described embodiments of the present invention are merely typical implementations of the present invention and may be variously modifiable within a range that does not depart the spirit of the present invention.

This application is based on, and claims priority to, JP PA 2015-103123 filed on 20 May 2015. The disclosure of the priority application, in its entirety, including the drawings, claims, and the specification thereof, are incorporated herein by reference.

What is claimed is:

1. A musical instrument comprising:

a performance operator;

an actuator configured to actuate the performance operator, the actuator including a movable member that, when moving, abuts against the performance operator to move the performance operator;

a first sensor configured to detect motion of the performance operator;

a second sensor configured to detect motion of the movable member of the actuator; and a processor configured to determine, based on outputs of the first and second sensors, whether or not the performance operator and the movable member of the actuator are currently in a mutually separated state, and, upon determination that the performance operator and the movable member are currently in the mutually separated state, control the actuator in such a manner that the performance operator and the movable member are in contact with each other.

2. The musical instrument as claimed in claim 1, wherein the processor is configured to determine, based on the outputs of the first and second sensors, whether or not a distance between the performance operator and the movable member is less than a predetermined threshold value, and upon determination that the distance between the performance operator and the movable member is not less than the predetermined threshold value, the processor determines that the performance operator and the movable member are currently in the mutually separated state.

3. The musical instrument as claimed in claim 1, wherein, upon determination that the performance operator and the movable member are not currently in the mutually separated state, the processor controls the actuator by use of feedback information based on the output of the first sensor, and upon determination that the performance operator and the movable member are currently in the mutually separated state, the processor controls the actuator by use of feedback information based on at least the output of the second sensor.

4. The musical instrument as claimed in claim 3, wherein, when controlling the actuator by use of the feedback information based on at least the output of the second sensor, the processor variably adjusts the feedback information based on the output of the second sensor in accordance with a tracking state, in servo control, of the actuator.

5. The musical instrument as claimed in claim 1, wherein the processor is configured to acquire information indicative of a velocity of the performance operator and a velocity of the movable member, wherein, upon determination that the performance operator and the movable member of the actuator are not currently in the mutually separated state, the processor determines, based on a difference between the velocity of the performance operator and the velocity of the movable member, whether or not the movable member is about to move away from the performance operator, and wherein, upon determination that the movable member is about to move away from the performance operator, the processor controls the actuator in such a manner as to restrain the movable member from moving away from the performance operator.

6. The musical instrument as claimed in claim 5, wherein the processor is configured to acquire information indicative of a position and velocity of the performance operator and a position and velocity of the movable member based on the outputs of the first and second sensors, wherein, upon determination that the movable member is about to move away from the performance operator, the processor controls the actuator by use of feedback information based on the position and velocity of the movable member acquired based on the output of the second sensor, and reduces respective loop gains of position and velocity servo control of the actuator in accordance with the difference between the velocity of the performance operator and the velocity of the movable member, and wherein, upon determination that the movable member is not about to move away from the performance operator, the processor controls the actuator by use of feedback information based on the position and velocity of the performance operator acquired based on the output of the first sensor.

7. The musical instrument as claimed in claim 1, wherein the processor is configured to acquire information indicative of a position and velocity of the performance operator and a position and velocity of the movable member based on the outputs of the first and second sensors, and the processor determines whether or not a distance between the position of the performance operator and the position of the movable member is less than a predetermined threshold value, and when the distance is not less than the predetermined threshold value, the processor determines that the performance operator and the movable member are currently in the mutually separated state.

8. The musical instrument as claimed in claim 1, wherein the processor is configured to acquire information indicative of a position and velocity of the performance operator and a position and velocity of the movable member based on the outputs of the first and second sensors, wherein, upon determination that the performance operator and the movable member of the actuator are not currently in the mutually separated state, the processor controls the actuator by use of feedback information based on the position and velocity of the performance operator, and wherein, upon determination that the performance operator and the movable member are currently in the mutually separated state, the processor controls the actuator by use of feedback information based on at least the position and velocity of the movable member.

9. The musical instrument as claimed in claim 1, wherein the processor is configured to acquire information indicative of a position and velocity of the performance operator and a position and velocity of the movable member based on the outputs of the first and second sensors, wherein, upon determination that the performance operator and the movable member of the actuator are not currently in the mutually separated state, the processor controls the actuator by use of feedback information based on the position and velocity of the performance operator, wherein, upon determination that the performance operator and the movable member are currently in the mutually separated state with a distance therebetween equal to or more than a predetermined threshold value, the processor controls the actuator by use of feedback information based on the position and velocity of the movable member, and sets respective loop gains of position and velocity servo control of the actuator at predetermined values, and wherein, upon determination that the performance operator and the movable member are currently in the mutually separated state with the distance therebetween less than the predetermined threshold value, the processor controls the actuator by use of feedback information based on the position and velocity of the performance operator.

10. The musical instrument as claimed in claim 1, wherein the processor is configured to:

acquire information indicating that the performance operator has been driven actually;

control the actuator by use of feedback information based on the output of the first sensor, upon determination that the performance operator and the movable member are not currently in the mutually separated state;

control the actuator by use of feedback information based on the output of the second sensor, upon determination that the performance operator and the movable member are currently in the mutually separated state with a distance therebetween equal to or more than a predetermined threshold value;

control the actuator by use of feedback information based on the output of the second sensor, upon determination that the performance operator and the movable member are currently in the mutually separated state with the distance therebetween less than the predetermined threshold value, and if the information indicating that the performance operator has been driven actually is received within a predetermined time; and control the actuator by use of feedback information based on the output of the first sensor, upon determination that the performance operator and the movable member are currently in the mutually separated state with the distance therebetween less than the predetermined threshold value, and if the information indicating that the performance operator has been driven actually is not received within the predetermined time.

11. The musical instrument as claimed in claim 1, which is a keyboard musical instrument including a plurality of keys, and wherein the performance operator is one of the plurality of keys, and the actuator and the first and second sensors are provided for each of the keys.

12. A method for controlling a musical instrument, the musical instrument including: a performance operator; an actuator configured to actuate the performance operator, the actuator including a movable member that, when moving, abuts against the performance operator to move the performance operator; a first sensor configured to detect motion of the performance operator; and a second sensor configured to detect motion of the movable member of the actuator, the method comprising:

determining, via a processor and based on outputs of the first and second sensors, whether or not the performance operator and the movable member are currently in a mutually separated state; and controlling, via the processor, the actuator in such a manner that the performance operator and the movable member are in contact with each other, upon determination that the performance operator and the movable member are currently in the mutually separated state.

13. A non-transitory machine-readable storage medium containing a program executable by a processor to perform a method for controlling a musical instrument, the musical instrument including: a performance operator; an actuator configured to actuate the performance operator, the actuator including a movable member that, when moving, abuts against the performance operator to move the performance operator; a first sensor configured to detect motion of the performance operator; and a second sensor configured to detect motion of the movable member of the actuator, the method comprising:

determining, based on outputs of the first and second sensors, whether or not the performance operator and the movable member are currently in a mutually separated state; and controlling the actuator in such a manner that the performance operator and the movable member are in contact with each other, upon determination that the performance operator and the movable member are currently in the mutually separated state.

* * * * *